US009773462B2

(12) United States Patent
Inada et al.

(10) Patent No.: US 9,773,462 B2
(45) **Date of Patent: *Sep. 26, 2017**

(54) LIQUID CRYSTAL DISPLAY DEVICE AND METHOD FOR DRIVING SAME

(71) Applicant: Sharp Kabushiki Kaisha, Osaka-shi, Osaka (JP)

(72) Inventors: Ken Inada, Osaka (JP); Taketoshi Nakano, Osaka (JP); Akizumi Fujioka, Osaka (JP); Asahi Yamato, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 46 days.

This patent is subject to a terminal disclaimer.

(21) Appl. No.: 14/420,956

(22) PCT Filed: Jun. 13, 2013

(86) PCT No.: PCT/JP2013/066372

§ 371 (c)(1),
(2) Date: Feb. 11, 2015

(87) PCT Pub. No.: WO2014/030411

PCT Pub. Date: Feb. 27, 2014

(65) Prior Publication Data

US 2015/0235600 A1 Aug. 20, 2015

(30) Foreign Application Priority Data

Aug. 24, 2012 (JP) ..... 2012-185885

(51) Int. Cl.
*G09G 5/10* (2006.01)
*G09G 3/36* (2006.01)

(52) U.S. Cl.
CPC ..... *G09G 3/3607* (2013.01); *G09G 3/3614* (2013.01); *G09G 3/3685* (2013.01);
(Continued)

(58) Field of Classification Search
None
See application file for complete search history.

(56) References Cited

U.S. PATENT DOCUMENTS 6,483,492 B1 11/2002 Takeuchi et al.
RE40,489 E 9/2008 Takeuchi et al.
(Continued)

FOREIGN PATENT DOCUMENTS

JP 4-288589 A 10/1992
JP 2004-004629 A 1/2004
(Continued)

OTHER PUBLICATIONS

Official Communication issued in International Patent Application No. PCT/JP2013/066372, mailed on Jul. 16, 2013.

*Primary Examiner* — Ifedayo Iluyomade
(74) *Attorney, Agent, or Firm* — Keating & Bennett, LLP

(57) ABSTRACT

The present invention provides a liquid crystal display device capable of suppressing a decrease in display quality when pause drive is performed in an alternating-voltage drive mode, as well as a method for driving the same.
In a first drive frame, overshoot drive is performed using correction values provided by an LUT to apply overshoot voltages whose absolute values are higher than absolute values of signal voltages to data signal lines. Subsequently, in a second drive frame, normal drive is performed to write signal voltages of the same polarity as the overshoot drive voltages to the data signal lines. Thereafter, a pause period in which an image written by normal drive is displayed continues until the start of a drive period in the next pause drive period. As a result, a decrease in luminance immediately after the signal voltages are written during the second drive frame is suppressed significantly, so that the viewer barely recognizes flicker.

16 Claims, 31 Drawing Sheets

(52) U.S. Cl.
CPC ... *G09G 2310/027* (2013.01); *G09G 2310/06* (2013.01); *G09G 2320/0242* (2013.01); *G09G 2320/0285* (2013.01); *G09G 2360/12* (2013.01)

(56) References Cited

U.S. PATENT DOCUMENTS

| | | | | |
|---|---|---|---|---|
| 2002/0093473 | A1 | 7/2002 | Tanaka et al. | |
| 2003/0020699 | A1 | 1/2003 | Nakatani et al. | |
| 2003/0179175 | A1 | 9/2003 | Shigeta et al. | |
| 2006/0158415 | A1 | 7/2006 | Izumi | |
| 2008/0001889 | A1* | 1/2008 | Chun | G09G 3/2011 345/96 |
| 2008/0224980 | A1 | 9/2008 | Senda et al. | |
| 2011/0074938 | A1 | 3/2011 | Nakahata | |
| 2011/0157128 | A1 | 6/2011 | Koyama | |
| 2011/0255778 | A1 | 10/2011 | Hashimoto et al. | |
| 2013/0002834 | A1 | 1/2013 | Aiba | |
| 2013/0222359 | A1 | 8/2013 | Nakata et al. | |
| 2014/0015820 | A1 | 1/2014 | Choi et al. | |
| 2015/0279294 | A1* | 10/2015 | Inada | G09G 3/3614 345/693 |

FOREIGN PATENT DOCUMENTS

| | | | |
|---|---|---|---|
| JP | 2004-185025 | A | 7/2004 |
| JP | 2006-195231 | A | 7/2006 |
| JP | 2011-8270 | A | 1/2011 |
| JP | 2011-075668 | A | 4/2011 |
| JP | 2011-75746 | A | 4/2011 |
| JP | 2011-150322 | A | 8/2011 |
| JP | 2011-205186 | A | 10/2011 |
| JP | 2011-221441 | A | 11/2011 |
| KR | 10-2008-0084081 | A | 9/2008 |
| WO | 2012/057044 | A1 | 5/2012 |

* cited by examiner

FIG. 2

70

| | | CURRENT FRAME | | | | | | | | |
|---|---|---|---|---|---|---|---|---|---|---|
| | | 0 | 32 | 64 | 96 | 128 | 160 | 192 | 224 | 255 |
| PREVIOUS FRAME | 0 | 3 | 8 | 7 | 6 | 5 | 3 | 1 | 1 | 1 |
| | 32 | 4 | 5 | 9 | 8 | 7 | 6 | 6 | 4 | 4 |
| | 64 | 5 | 6 | 4 | 9 | 5 | 5 | 4 | 4 | 3 |
| | 96 | 4 | 7 | 4 | 4 | 4 | 4 | 3 | 2 | 2 |
| | 128 | 3 | 3 | 4 | 4 | 4 | 5 | 4 | 4 | 2 |
| | 160 | 3 | 3 | 4 | 4 | 4 | 3 | 4 | 4 | 1 |
| | 192 | 2 | 3 | 3 | 3 | 3 | 4 | 3 | 5 | 1 |
| | 224 | 2 | 2 | 2 | 2 | 3 | 3 | 3 | 2 | 0 |
| | 255 | 1 | 2 | 2 | 3 | 3 | 2 | 1 | 1 | 0 |

FIG. 13

270

| | CURRENT FRAME | | | | | | | | |
|---|---|---|---|---|---|---|---|---|---|
| | 0 | 32 | 64 | 96 | 128 | 160 | 192 | 224 | 255 |
| PREVIOUS FRAME | | | | | | | | | |
| 0 | 3 | — | — | — | — | — | — | — | — |
| 32 | — | 5 | — | — | — | — | — | — | — |
| 64 | — | — | 4 | — | — | — | — | — | — |
| 96 | — | — | — | 4 | — | — | — | — | — |
| 128 | — | — | — | — | 4 | — | — | — | — |
| 160 | — | — | — | — | — | 3 | — | — | — |
| 192 | — | — | — | — | — | — | 3 | — | — |
| 224 | — | — | — | — | — | — | — | 2 | — |
| 255 | — | — | — | — | — | — | — | — | 0 |

370

| CURRENT FRAME | | | | | | | |
|---|---|---|---|---|---|---|---|
| 0 | 32 | 64 | 96 | 128 | 160 | 192 | 224 | 255 |
| 3 | 8 | 7 | 6 | 5 | 3 | 1 | 1 | 1 |

FIG. 17

FIG. 22

470a

| | | CURRENT FRAME | | | | | | | | |
|---|---|---|---|---|---|---|---|---|---|---|
| | | 0 | 32 | 64 | 96 | 128 | 160 | 192 | 224 | 255 |
| PREVIOUS FRAME | 0 | 3 | 8 | 7 | 6 | 5 | 3 | 1 | 1 | 1 |
| | 32 | 4 | 5 | 9 | 8 | 7 | 6 | 6 | 4 | 4 |
| | 64 | 5 | 6 | 4 | 9 | 5 | 5 | 4 | 4 | 3 |
| | 96 | 4 | 7 | 4 | 4 | 4 | 4 | 3 | 2 | 2 |
| | 128 | 3 | 3 | 4 | 4 | 4 | 5 | 4 | 4 | 2 |
| | 160 | 3 | 3 | 4 | 4 | 4 | 3 | 4 | 4 | 1 |
| | 192 | 2 | 3 | 3 | 3 | 3 | 4 | 3 | 5 | 1 |
| | 224 | 2 | 2 | 2 | 2 | 3 | 3 | 3 | 2 | 0 |
| | 255 | 1 | 2 | 2 | 3 | 3 | 2 | 1 | 1 | 0 |

FIG. 23

470b

| | | CURRENT FRAME | | | | | | | | |
|---|---|---|---|---|---|---|---|---|---|---|
| | | 0 | 32 | 64 | 96 | 128 | 160 | 192 | 224 | 255 |
| PREVIOUS FRAME | 0 | 2 | 4 | 4 | 3 | 3 | 2 | 1 | 1 | 1 |
| | 32 | 2 | 3 | 5 | 4 | 4 | 3 | 3 | 2 | 2 |
| | 64 | 3 | 3 | 2 | 5 | 3 | 3 | 2 | 2 | 2 |
| | 96 | 2 | 4 | 2 | 2 | 2 | 2 | 2 | 1 | 1 |
| | 128 | 2 | 2 | 2 | 2 | 2 | 3 | 2 | 2 | 1 |
| | 160 | 2 | 2 | 2 | 2 | 2 | 2 | 2 | 2 | 1 |
| | 192 | 1 | 2 | 2 | 2 | 2 | 2 | 2 | 3 | 1 |
| | 224 | 1 | 1 | 1 | 1 | 2 | 2 | 2 | 1 | 0 |
| | 255 | 1 | 1 | 1 | 2 | 2 | 1 | 1 | 1 | 0 |

FIG. 24

470c

| | | CURRENT FRAME | | | | | | | | |
|---|---|---|---|---|---|---|---|---|---|---|
| | | 0 | 32 | 64 | 96 | 128 | 160 | 192 | 224 | 255 |
| PREVIOUS FRAME | 0 | 6 | 12 | 12 | 9 | 9 | 6 | 3 | 3 | 3 |
| | 32 | 6 | 9 | 15 | 12 | 12 | 9 | 9 | 6 | 6 |
| | 64 | 9 | 9 | 6 | 15 | 9 | 9 | 6 | 6 | 6 |
| | 96 | 6 | 12 | 6 | 6 | 6 | 6 | 6 | 3 | 3 |
| | 128 | 6 | 6 | 6 | 6 | 6 | 9 | 6 | 6 | 3 |
| | 160 | 6 | 6 | 6 | 6 | 6 | 6 | 6 | 6 | 3 |
| | 192 | 3 | 6 | 6 | 6 | 6 | 6 | 6 | 9 | 3 |
| | 224 | 3 | 3 | 3 | 3 | 6 | 6 | 6 | 3 | 0 |
| | 255 | 3 | 3 | 3 | 6 | 6 | 3 | 3 | 3 | 0 |

LIQUID CRYSTAL DISPLAY DEVICE AND METHOD FOR DRIVING SAME

TECHNICAL FIELD

The present invention relates to liquid crystal display devices and methods for driving the same, particularly to a liquid crystal display device capable of performing pause drive in an alternating-voltage drive mode and a method for driving the same.

BACKGROUND ART

Recent years have seen active development of compact and lightweight electronic devices. Liquid crystal display devices mounted in such electronic devices are required to consume less power. A drive method to reduce power consumption by the liquid crystal display device is a drive method called "pause drive" with drive periods in which scanning lines are scanned to write signal voltages and pause periods in which the writing is paused by keeping all of the scanning lines in unscanned state. In the pause drive, a scanning line driver circuit and/or a data signal line driver circuit are/is provided with no control signals and suchlike during the pause period, so that the operation of the scanning line driver circuit and/or the data signal line driver circuit can be stopped. As a result, it is possible to reduce power consumption by the liquid crystal display device. The pause drive as described above is also referred to as "low-frequency drive" or "intermittent drive".

In a liquid crystal panel for use in the liquid crystal display device, a liquid crystal layer is provided between two electrodes. When a voltage is applied to the liquid crystal layer, the orientation direction (i.e., the longitudinal direction) of liquid crystal molecules in the liquid crystal layer changes because of dielectric anisotropy of the liquid crystal. Moreover, liquid crystals have optical anisotropy, and therefore, when the orientation direction of the liquid crystal molecules changes, the direction of polarization of light to be transmitted through the liquid crystal layer changes. Accordingly, the amount of light to be transmitted through the liquid crystal layer can be controlled in accordance with the voltage applied to the liquid crystal layer. Thus, it is possible to display an image on the liquid crystal panel with the luminance of each pixel forming portion at a desired grayscale luminance value.

However, it takes a certain period of time for the liquid crystal to respond to a change in the applied voltage. For example, in the case of a widely used TN (Twisted Nematic), IPS (In-Plane Switching), or VA (Vertically Aligned) liquid crystal display device, it might take a time period of about 50 ms until the liquid crystal responds. In addition, it is known that the response speed of the liquid crystal changes in accordance with the temperature, and the response speed decreases as the temperature lowers.

Furthermore, when the frequency of an image signal is 60 Hz, the duration of a frame period is 16.7 ms. Accordingly, if the response period of the liquid crystal becomes longer than one frame period, image lag might occur on the screen, resulting in reduced image display quality.

Therefore, to solve the above problems, for example, Japanese Laid-Open Patent Publication No. 2004-4629 discloses a liquid crystal display device in which "overshoot drive" is performed to apply a higher voltage to a liquid crystal layer than a normally applied voltage. The overshoot drive is performed using a look-up table (referred to as an "LUT" or a "table") in which correction values are stored and correlated with combinations of grayscale values for the previous and current frames. More specifically, a correction value corresponding to a combination of grayscale values for the previous and current frames is read from the LUT and used to correct an input image signal, so that the corrected image signal is outputted. By performing overshoot drive using such a corrected image signal, it is rendered possible to increase the response speed of the liquid crystal, and hence the response speed of the liquid crystal display device.

CITATION LIST

Patent Document

Patent Document 1: Japanese Laid-Open Patent Publication No. 2004-4629

SUMMARY OF THE INVENTION

Problems to be Solved by the Invention

In the liquid crystal display device, if voltages of the same polarity continue to be applied to the liquid crystal layer, image persistence might occur in the liquid crystal layer, resulting in deterioration of the liquid crystal layer. Therefore, to prevent image persistence in the liquid crystal layer, alternating-voltage drive in which the polarity of signal voltages is inverted upon each writing is performed. FIG. 30 is a diagram describing a conventional method for performing pause drive in an alternating-voltage drive mode. As shown in FIG. 30, in a first pause drive period, initially, signal voltages of the positive polarity are written, and the signal voltages are maintained during the following pause period. In a second pause drive period, initially, signal voltages of the negative polarity are written, and the signal voltages are maintained during the following pause period. Thereafter, similar operations are repeated such that signal voltages are written with their polarities inverted alternatingly every pause drive period, and maintained during their respective following pause periods.

FIG. 31 is a diagram schematically illustrating changes in luminance where pause drive is performed as shown in FIG. 30. As shown in FIG. 31, the luminance decreases sharply immediately after signal voltages are written, and returns slowly to the original value, and the same is repeated thereafter. This phenomenon occurs when the polarity of the signal voltages is inverted, because the orientation direction of liquid crystal molecules cannot follow such a change. When a video is displayed, such a decrease in luminance can barely be recognized by the viewer because the image change speed is fast. However, during pause drive, the viewer recognizes such a change in luminance as flicker, so there is a problem with reduced image display quality.

Note that the reason why the luminance during the pause period rises gradually as the voltages which have fallen at the time of polarity inversion the signal voltages over time is because thin-film transistors (referred to below as "TFTs") whose channel layers are made of an oxide semiconductor are used as switching elements in the pixel forming portions. Details of the TFTs whose channel layers are made of an oxide semiconductor will be described later.

Therefore, an objective of the present invention is to provide a liquid crystal display device capable of suppressing a decrease in display quality when pause drive is performed in an alternating-voltage drive mode, as well as a method for driving the same.

Means for Solving the Problems

A first aspect of the present invention is directed to a liquid crystal display device formed on an insulating substrate and performing pause drive in an alternating-voltage drive mode, the device including:

a plurality of scanning signal lines;

a plurality of data signal lines crossing each of the scanning signal lines;

pixel forming portions formed at intersections of the scanning signal lines and the data signal lines;

a correction circuit for outputting either a corrected image signal obtained by subjecting an input image signal to a tone emphasizing process for emphasizing a temporal change in the signal or an image signal being an input image signal not subjected to the tone emphasizing process;

a scanning signal line driver circuit for sequentially selecting and scanning the scanning signal lines;

a data signal line driver circuit for writing to the data signal lines correction voltages in accordance with the corrected image signal outputted by the correction circuit or signal voltages in accordance with the image signal; and a timing control circuit for controlling the scanning signal line driver circuit and the data signal line driver circuit, wherein, the pause drive alternatingly repeats a drive period consisting of a plurality of drive frames and a pause period following the drive period and lasting until the start of the next drive period, the correction circuit outputs the corrected image signal to the data signal line driver circuit at least during the first drive frame of the drive period and also outputs the image signal to the data signal line driver circuit during the last drive frame, and the correction voltage in accordance with the corrected image signal has the same polarity as the signal voltage in accordance with the image signal and an absolute value greater than or equal to an absolute value of the signal voltage.

In a second aspect of the present invention, based on the first aspect of the invention, the correction circuit includes frame memory for storing the input image signal every frame, a comparator circuit for obtaining grayscale values for a current frame for the input image signal and grayscale values for a previous frame stored in the frame memory, a table having stored correction values correlated with combinations of grayscale values for the current and previous frames for the input image signals, and an adder circuit for outputting either the corrected image signal or the image signal to the data signal line driver circuit in accordance with the input image signal, the table provides the adder circuit with the correction values correlated with the grayscale values for the current and previous frames every time the comparator circuit provides the grayscale values for the current and previous frames for the input image signal, and the adder circuit outputs the corrected image signal by correcting the grayscale values for the input image signal with the correction values provided by the table and also outputs the image signal without correcting the grayscale values for the input image signal.

In a third aspect of the present invention, based on the second aspect of the invention, the adder circuit outputs the corrected image signal in each of two or more consecutive drive frames including the first drive frame, and outputs the image signal during the last drive frame.

In a fourth aspect of the present invention, based on the first aspect of the invention, the correction circuit includes frame memory for storing the input image signal every frame, a comparator circuit for obtaining grayscale values for a current frame for the input image signal and grayscale values for a previous frame stored in the frame memory, a table having stored correction values correlated with combinations of grayscale values for the current and previous frames for the input image signals when the grayscale values for the current and previous frames are equal, and an adder circuit for outputting either the corrected image signal or the image signal in accordance with the input image signal, the comparator circuit provides the table with grayscale values for the current and previous frames for the input image signal only when the grayscale values for the current and previous frames for the input image signal are essentially equal, the table provides the adder circuit with the correction values correlated with the grayscale values for the current and previous frames provided by the comparator circuit, when the grayscale values for the current and previous frames for the input image signal are essentially equal, the adder circuit outputs the corrected image signal by correcting the grayscale values for the input image signal with the correction values provided by the table and also outputs the image signal without correcting the grayscale values for the input image signal, and when the grayscale values for the current and previous frames for the input image signal are essentially not equal, the adder circuit outputs the corrected image signal at least once without correcting the grayscale values for the input image signal.

In a fifth aspect of the present invention, based on the fourth aspect of the invention, when the grayscale values for the current and previous frames for the input image signal are essentially not equal, the adder circuit outputs the corrected image signals successively without correcting the grayscale values for the input image signal.

In a sixth aspect of the present invention, based on the fourth or fifth aspect of the invention, the comparator circuit further obtains an inverting direction in which the input image signal is inverted in polarity for each of the drive periods, and the table includes first and second tables having stored different correction values in accordance with directions of the polarity, such that every time grayscale values for the current and previous frames for the input image signal and a direction of the polarity are provided by the comparator circuit, the adder circuit is provided with the correction values correlated with the grayscale values for the current and previous frames from one of the first and second tables corresponding to the direction of the polarity.

In a seventh aspect of the present invention, based on the first aspect of the invention, the correction circuit includes frame memory for storing the input image signal every frame, a table having stored correction values correlated with grayscale values for a current frame for the input image signal, and an adder circuit for outputting either the corrected image signal or the image signal in accordance with the input image signal, the table provides the adder circuit with correction values corresponding to the grayscale values for the current frame every time the input image signal is provided, and the adder circuit outputs the corrected image signal by correcting the grayscale values for the input image signal with the correction values provided by the table and also outputs the image signal without correcting the grayscale values for the input image signal.

In an eighth aspect of the present invention, based on the first aspect of the invention, the correction circuit includes frame memory for storing the input image signal every frame, and an adder circuit for outputting either the corrected image signal or the image signal in accordance with the input image signal, and the adder circuit stores one correction value and outputs the corrected image signal by correcting the grayscale values for the input image signal with the correction value, while outputting the image signal without correcting the grayscale values for the input image signal.

In a ninth aspect of the present invention, based on the second or seventh aspect of the invention, the liquid crystal display device further includes a temperature sensor for measuring an ambient temperature around the liquid crystal display device, the table includes a plurality of sub-tables having stored different correction values for predetermined temperature ranges, and one of the sub-tables is selected in accordance with temperature information provided by the temperature sensor.

In a tenth aspect of the present invention, based on the second or seventh aspect of the invention, the liquid crystal display device further includes a temperature sensor for measuring an ambient temperature around the liquid crystal display device, the correction circuit further includes non-volatile memory for storing a plurality of data items for different correction values for predetermined temperature ranges, and one of the data items is selected and provided to the table in accordance with temperature information provided by the temperature sensor.

In an eleventh aspect of the present invention, based on the ninth or tenth aspect of the invention, the temperature sensor is provided on the insulating substrate, and the temperature sensor provides the temperature information to the timing control circuit via serial communication.

In a twelfth aspect of the present invention, based on the ninth or tenth aspect of the invention, the temperature sensor is provided in the timing control circuit.

In a thirteenth aspect of the present invention, based on the first aspect of the invention, the pixel forming portion includes a thin-film transistor having a control terminal connected to the scanning signal line, a first conductive terminal connected to the data signal line, a second conductive terminal connected to a pixel electrode to which the correction voltage or the signal voltage is to be applied, and a channel layer formed of an oxide semiconductor.

In a fourteenth aspect of the present invention, based on the first aspect of the invention, the pixel forming portion includes a thin-film transistor having a control terminal connected to the scanning signal line, a first conductive terminal connected to the data signal line, a second conductive terminal connected to a pixel electrode to which the correction voltage or the signal voltage is to be applied, and a channel layer formed of either an amorphous semiconductor or a polycrystalline semiconductor.

In a fifteenth aspect of the present invention, based on any of the first through fourteenth aspects of the invention, the liquid crystal display device is driven by dot-by-dot inversion drive, line-by-line inversion drive, column-by-column inversion drive, or frame-by-frame inversion drive in the alternating-voltage drive mode.

A sixteenth aspect of the present invention is directed to a method for driving a liquid crystal display device performing pause drive in an alternating-voltage drive mode and including a plurality of scanning signal lines, a plurality of data signal lines crossing each of the scanning signal lines, pixel forming portions formed at intersections of the scanning signal lines and the data signal lines, a correction circuit for outputting either a corrected image signal obtained by subjecting an input image signal to a tone emphasizing process for emphasizing a temporal change in the signal or an image signal being an input image signal not subjected to the tone emphasizing process, a scanning signal line driver circuit for sequentially selecting and scanning the scanning signal lines, and a data signal line driver circuit for writing to the data signal lines correction voltages in accordance with the corrected image signal or signal voltages in accordance with the image signal, the method including the steps of:

outputting the corrected image signal at least during the first of a plurality of drive frames provided in a drive period;

outputting the image signal during the last drive frame, wherein the signal voltage has the same polarity as the correction voltage and an absolute value less than or equal to an absolute value of the correction voltage; and setting a pause period following the drive period and lasting until the start of the next drive period.

Effects of the Invention

In the first aspect of the present invention, the correction circuit outputs the corrected image signal to the data signal line driver circuit at least during the first drive frame of the drive period, and also outputs the image signal during the last drive frame. At this time, the correction voltages in accordance with the corrected image signal have the same polarity as the signal voltages in accordance with the image signal, and also have absolute values greater than or equal to absolute values of the signal voltages. As a result, a decrease in luminance at the time of writing the signal voltages is suppressed significantly, so that the viewer barely recognizes flicker. Thus, image display quality can be enhanced.

In the second aspect of the present invention, when the tone emphasizing process is performed, the adder circuit provided in the correction circuit outputs the corrected image signal, which is obtained by correcting the grayscale values for the input image signal with the correction values provided by the table, and thereafter, the adder circuit outputs the input image signal without correcting the grayscale values. As a result, a decrease in luminance at the time of writing the signal voltages is suppressed significantly, regardless of the grayscale values for the input image signal, so that the viewer barely recognizes flicker.

In the third aspect of the present invention, the adder circuit outputs the corrected image signal in each of two or more consecutive drive frames, including the first drive frame. As a result, the liquid crystal display device performs the tone emphasizing process at least twice in succession during the drive period of each pause drive period. Thus, even in the case of a liquid crystal with a slow response speed, liquid crystal molecules can be reliably oriented in the direction of an applied voltage.

In the fourth aspect of the present invention, since flicker is recognizable in the case where the same image continues to be displayed, the adder circuit outputs the corrected image signal, which is obtained by correcting the grayscale values for the input image signal with the correction values provided by the table, only when the grayscale values for the current and previous frames for the input image signal are essentially equal. Accordingly, the tone emphasizing process is performed only when images with essentially equal grayscale values are displayed successively, and thereafter, normal drive is performed. As a result, the viewer barely recognizes flicker. Moreover, the size of the table can be reduced, resulting in reduced cost for the liquid crystal display device. In addition, in the case where the liquid crystal has a high response speed, and the grayscale values for the previous and current frames are different, only the first drive frame may be set so as to be followed by a pause period rather than by the second drive frame. Setting no second drive frame reduces power consumption by the liquid crystal display device.

In the fifth aspect of the present invention, when the grayscale values for the current and previous frames for the input image signal are essentially not equal, the corrected image signal continues to be outputted without correcting the grayscale values for the input image signal. Thus, even in the case where the liquid crystal has a low response speed, liquid crystal molecules can be reliably oriented in the direction of an applied voltage.

In the sixth aspect of the present invention, the table includes the first table for storing correction values for one direction of an applied voltage and the second table for storing correction values for the other direction of the applied voltage. As a result, even if the response speed of the liquid crystal varies depending on the direction of a voltage applied to the liquid crystal layer, a suitable one of the first and second tables is selected so that a decrease in luminance due to the direction of the applied voltage at the time of writing can be kept down to approximately the same level. Thus, the viewer barely recognizes flicker.

The seventh aspect of the present invention eliminates the need to determine whether the grayscale values for the previous and current frames are equal, and hence eliminates the need for the comparator circuit. In addition, since no comparator circuit is provided, the table is only required to store correction values correlated with grayscale values for the current frame, and therefore, can be reduced in size. Thus, it is possible to reduce the production cost for the liquid crystal display device.

In the eighth aspect of the present invention, the adder circuit has stored one correction value which can be used in subjecting the input image signal to the tone emphasizing process regardless of the grayscale values for the input image signal, and therefore, the need for both the table and the adder circuit is eliminated. Thus, the production cost for the liquid crystal display device can be further reduced.

In the ninth aspect of the present invention, the temperature sensor and the sub-tables for storing different correction values for temperatures are provided, and one of the sub-tables is selected depending on an ambient temperature around the liquid crystal display device to perform the tone emphasizing process. Thus, in liquid crystal display devices for use in a wide range of temperatures also, the decrease in luminance at the time of writing the signal voltages can be suppressed so that the viewer barely recognizes flicker.

The tenth aspect of the present invention includes the nonvolatile memory for storing data items for different correction values for predetermined temperature ranges, and the nonvolatile memory provides the table with one of the data items that is selected on the basis of temperature information. As a result, in the case where the liquid crystal display device is used in a wide range of temperatures, the nonvolatile memory has prestored correction values to be stored in a plurality of tables, and transfers data for correction values for a temperature range corresponding to temperature information provided by the temperature sensor. Thus, the number of tables can be reduced, resulting in reduced production cost for the liquid crystal display device.

In the eleventh aspect of the present invention, the temperature sensor is provided on the insulating substrate, and provides the temperature information to the timing control circuit via serial communication, and the temperature sensor can be provided in any position on the insulating substrate.

In the twelfth aspect of the present invention, the temperature sensor is provided in the timing control circuit, and therefore, the circuit configuration of the timing control circuit does not become complex. Thus, the production cost for the liquid crystal display device can be reduced.

In the thirteenth aspect of the present invention, the thin-film transistor used in the pixel forming portion is a thin-film transistor with a channel layer formed of an oxide semiconductor. The thin-film transistor offers very low off-leakage current, and therefore, the voltage written in the pixel forming portion can be maintained for a long period of time. Thus, multitone display can be provided even during pause drive.

In the fourteenth aspect of the present invention, the thin-film transistor used in the pixel forming portion is a thin-film transistor with a channel layer formed of an amorphous semiconductor or a polycrystalline semiconductor. Thus, a liquid crystal display device which can be produced at low cost is allowed to display an image, such as a black-and-white image, which can be displayed with two luminance values.

The fifteenth aspect of the present invention allows the liquid crystal display device according to any of the first through fourteenth aspects of the invention to be driven by dot-by dot inversion drive, line-by-line inversion drive, column-by-column inversion drive, or frame-by-frame inversion drive, so that the decrease in luminance due to the writing of the signal voltages can be suppressed significantly. This allows the viewer to barely recognize flicker, and also contributes to enhanced image display quality.

BRIEF DESCRIPTION OF THE DRAWINGS

FIG. 2 is a diagram showing an example of the configuration of an LUT used in the liquid crystal display device shown in FIG. 1.

FIG. 13 is a diagram showing an example of the configuration of an LUT used in the liquid crystal display device shown in FIG. 12.

FIG. 17 is a diagram showing an example of the configuration of an LUT used in the liquid crystal display device shown in FIG. 16.

FIG. 22 is a diagram showing an LUT for room temperature for use in the liquid crystal display device shown in FIG. 21.

FIG. 23 is a diagram showing an LUT for high temperature for use in the liquid crystal display device shown in FIG. 21.

FIG. 24 is a diagram showing an LUT for low temperature for use in the liquid crystal display device shown in FIG. 21.

MODES FOR CARRYING OUT THE INVENTION

1. First Embodiment

<1.1 Configuration of the Liquid Crystal Display Device>

Figure 1:
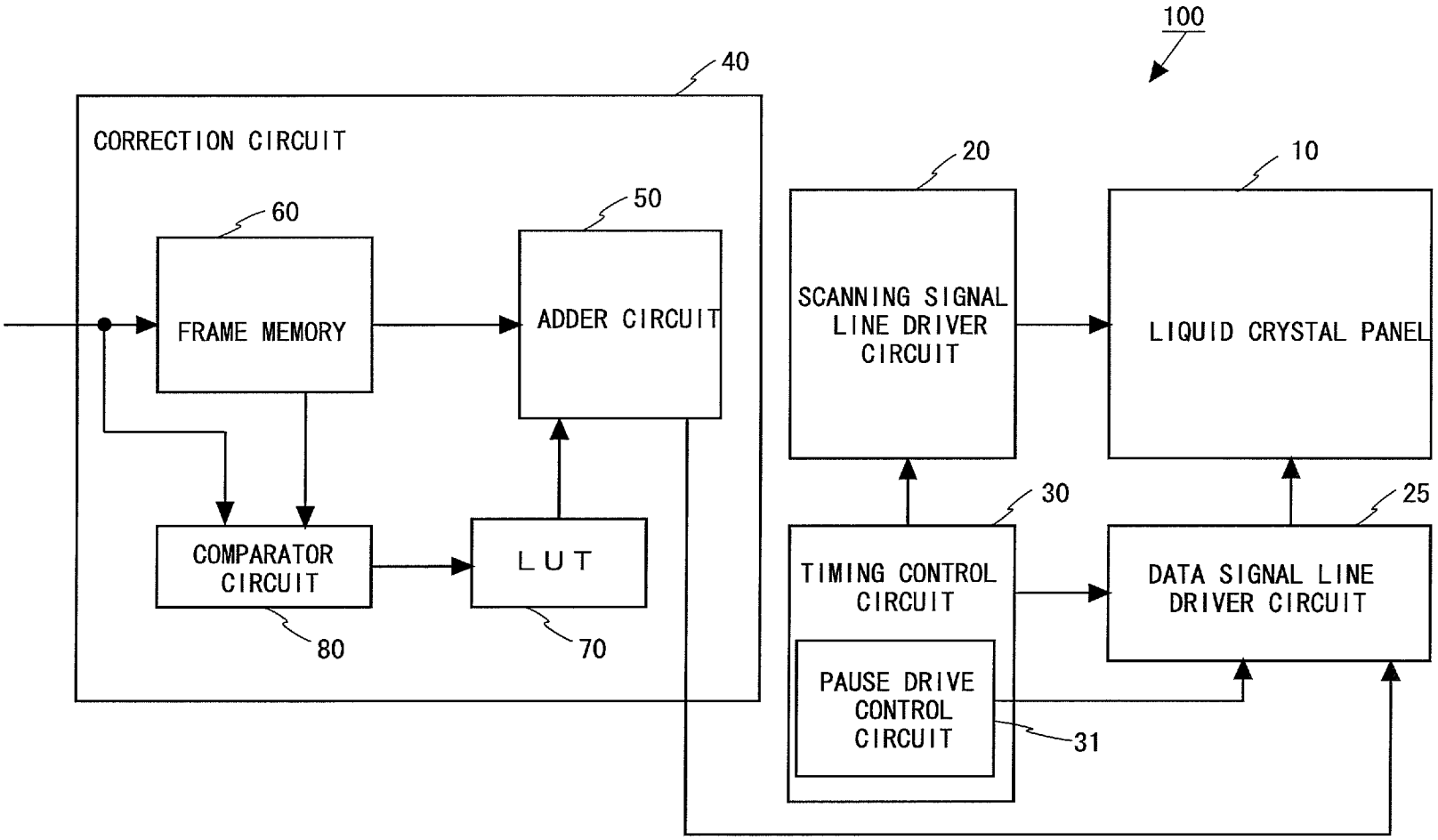
FIG. 1 is a block diagram illustrating the configuration of a liquid crystal display device according to a first embodiment of the present invention.

FIG. 1 is a block diagram illustrating the configuration of a liquid crystal display device 100 according to a first embodiment of the present invention. The liquid crystal display device 100 shown in FIG. 1 includes a liquid crystal panel 10, a scanning signal line driver circuit 20, a data signal line driver circuit 25, a timing control circuit 30, and a correction circuit 40.

The liquid crystal panel 10 has a plurality of pixel forming portions (not shown) arranged in a matrix of rows and columns. Moreover, the liquid crystal panel 10 has a plurality of scanning signal lines (not shown) and a plurality of data signal lines (not shown) formed crossing each other. Each scanning signal line is connected to pixel forming portions arranged in the same row, whereas each data signal line is connected to pixel forming portions arranged in the same column.

A horizontal synchronization signal and a vertical synchronization signal are inputted to the timing control circuit 30 as synchronization signals for an input image signal. On the basis of the synchronization signals, the timing control circuit 30 generates and outputs control signals, such as a gate clock signal and a gate start pulse signal, to the scanning signal line driver circuit 20, and also generates and outputs control signals, such as a source clock signal and a source start pulse signal, to the data signal line driver circuit 25.

Furthermore, the timing control circuit 30 includes a pause drive control circuit 31. The pause drive control circuit 31 outputs an amplifier enable signal to the data signal line driver circuit 25 in synchronization with the generated control signals. As will be described in detail later, the liquid crystal display device 100 sets a drive period in which overshoot voltages (also referred to as "correction voltages") or signal voltages are written to drive the liquid crystal panel 10, as well as a pause period in which the writing is paused. In the drive period, the pause drive control circuit 31 activates the amplifier enable signal, thereby causing an analog amplifier (not shown) provided in the data signal line driver circuit 25 to operate. As a result, the overshoot voltages or the signal voltages can be written to the data signal lines. In the pause period, the amplifier enable signal is deactivated, thereby pausing the analog amplifier. In this manner, the pause drive control circuit 31 can set the drive period and the pause period arbitrarily.

The scanning signal line driver circuit 20 drives the scanning signal lines of the liquid crystal panel 10 in accordance with the control signals generated by the timing control circuit 30, thereby sequentially selecting the scanning signal lines. The data signal line driver circuit 25 converts a corrected image signal outputted by the correction circuit 40 into signal voltages, which are analog voltages, in accordance with the control signals generated by the timing control circuit 30, and writes the signal voltages to the data signal lines. Moreover, overshoot voltages, which are generated in a manner to be described later, are written to the data signal lines. Note that the data signal line driver circuit 25 writes the signal voltages and the overshoot voltages to the data signal lines only when the data signal line driver circuit 25 is receiving an active amplifier enable signal from the pause drive control circuit 31.

Note that the data signal line driver circuit 25 will be described herein as performing dot-by-dot inversion drive to display an image on the liquid crystal panel 10, and therefore, the polarity of signal voltages corresponding to a corrected image signal are controlled in the following manner. Specifically, signal voltages, which are inverse in polarity and are outputted simultaneously for each adjacent pair of data signal lines, are inverted in polarity every scanning signal line. Accordingly, any pixel forming portion having a signal voltage of the positive polarity written therein is surrounded by pixel forming portions having signal voltages of the negative polarity written therein, whereas any pixel forming portion having a signal voltage of the negative polarity written therein is surrounded by pixel forming portions having signal voltages of the positive polarity written therein.

The correction circuit 40 outputs a corrected image signal, which is obtained by subjecting an input image signal to a correction for emphasizing a change in the signal, to the data signal line driver circuit 25. The correction circuit 40 includes an adder circuit 50, frame memory 60, a comparator circuit 80, and an LUT 70. The frame memory 60 stores an externally provided input image signal for one frame. The comparator circuit 80 obtains a grayscale value for the externally provided input image signal (i.e., a grayscale value for the current frame) and a grayscale value stored in the frame memory 60 for the input image signal in the immediately previous frame period (i.e., a grayscale value for the previous frame), and provides the results to the LUT 70. The LUT 70 has a plurality of correction values stored therein and correlated with grayscale values for the previous and current frames, as will be described later. When the LUT 70 is provided with grayscale values for the previous and current frames from the comparator circuit 80, the LUT 70 provides a correction value corresponding thereto to the adder circuit 50. Note that the LUT will also be referred to herein as a "table".

The adder circuit 50 is connected to the frame memory 60, and the input image signal stored in the frame memory 60 is provided to the adder circuit 50. When overshoot voltages are written, the input image signal is provided to the adder circuit 50 immediately after the signal is stored in the frame memory 60. The adder circuit 50 generates a corrected image signal by adding a correction value for the grayscale value for the current frame provided by the LUT 70 to the input image signal, and outputs the generated signal to the data signal line driver circuit 25.

Next, the input image signal stored in the frame memory 60 is provided to the adder circuit 50. The input image signal is the same input image signal as that used for generating the corrected image signal. The adder circuit 50 outputs the grayscale value for the current frame to the data signal line driver circuit 25 as an image signal without correction. Note that in some cases herein, a signal obtained by adding a correction value to the input image signal by the adder circuit 50 might be referred to as a corrected image signal, and a signal to which no correction value has been added might be referred to as an image signal.

FIG. 2 is a diagram showing an example of the configuration of the LUT 70 used in the liquid crystal display device 100. The LUT 70 has stored therein correction values for emphasizing temporal changes in input image signals, such that the correction values are correlated with combinations of grayscale values for the previous and current frames, as shown in FIG. 2. For example, in the case where the grayscale value for the previous frame is 32, and the grayscale value for the current frame is 160, their corresponding correction value is 6 in the LUT 70. The LUT 70 provides this correction value to the adder circuit 50, so that the adder circuit 50 generates a corrected image signal for the grayscale value "166" by adding the correction value "6" to the grayscale value "160" for an input image signal directly provided from outside (i.e., the grayscale value for the current frame), and outputs the generated signal to the data signal line driver circuit 25. The data signal line driver circuit 25 obtains overshoot voltages corresponding to the corrected image signal, and writes them to the data signal lines SL. In this manner, overshoot drive (also referred to as a "tone emphasizing process") is performed.

Note that the liquid crystal display device 100 will be described herein as a display device capable of displaying 256 grayscale values in the grayscale range from 0 to 255. The LUT 70 shown in FIG. 2 lists the grayscale values for the previous and current frames approximately at intervals of 32 grayscale levels. The reason for this is to avoid the LUT 70 becoming excessively large, and any correction values not listed in the LUT 70 but corresponding to grayscale values for the previous and current frames are obtained by well-known interpolation operations. Note that the configuration of the LUT 70 shown in FIG. 2 is merely an example, and any LUT having more or fewer grayscale values for the previous and current frames than the LUT 70 may be used.

<1.2 Configuration of the Pixel Forming Portion>

Figure 3:
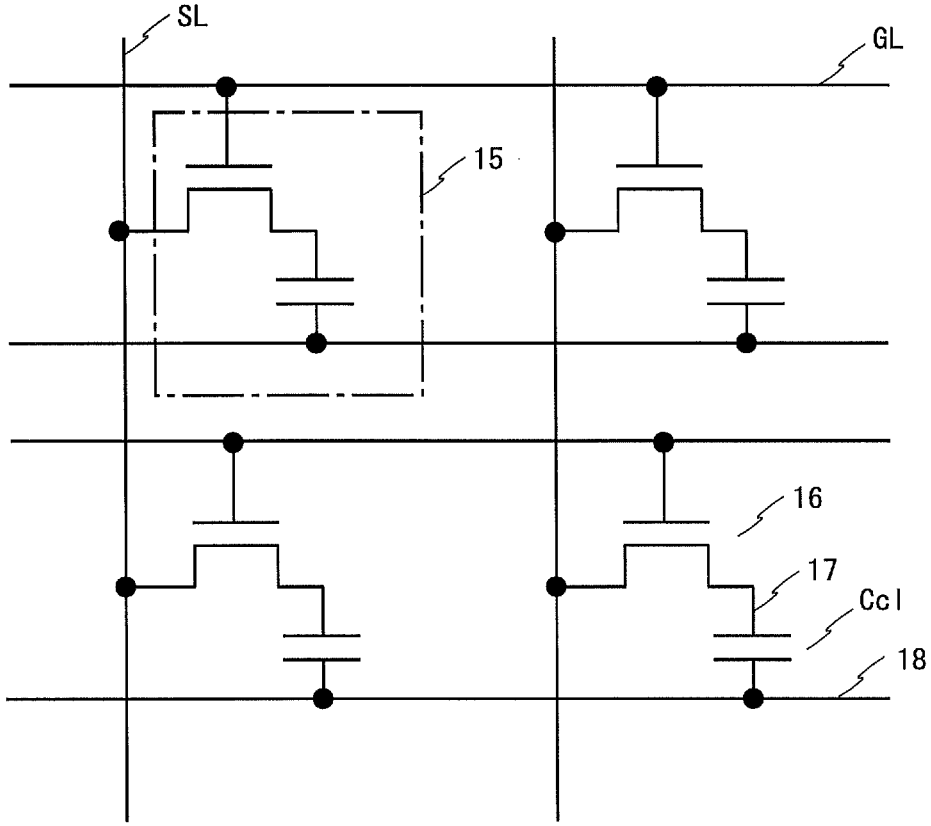
FIG. 3 is a diagram illustrating equivalent circuits of pixel forming portions included in the liquid crystal display device shown in FIG. 1.

FIG. 3 is a diagram illustrating equivalent circuits of pixel forming portions 15 included in the liquid crystal display device 100. As shown in FIG. 3, each pixel forming portion 15 includes a TFT 16 having a gate terminal, which serves as a control terminal, connected to a scanning signal line GL passing through a corresponding intersection, and a source terminal, which serves as a first conductive terminal, connected to a data signal line SL passing through the intersection, a pixel electrode 17 connected to a drain terminal of the TFT 16, which serves as a second conductive terminal, a common electrode 18 provided commonly for the pixel forming portions 15, and a liquid crystal layer provided commonly for the pixel forming portions 15 between the pixel electrode 17 and the common electrode 18. Liquid crystal capacitance Ccl is formed by the pixel electrode 17 and the common electrode 18 and serves as pixel capacitance. A voltage applied to the common electrode 18 is generated by a common voltage generating circuit (not shown). Note that it is often the case that auxiliary capacitance is provided parallel to the liquid crystal capacitance Ccl in order to reliably maintain the voltage in the pixel capacitance, but the pixel capacitance will be described herein as being formed solely by the liquid crystal capacitance Ccl.

The TFT 16 shown in FIG. 3 functions as a switching element, which is turned on to write a signal voltage in the liquid crystal capacitance Ccl or turned off to maintain the signal voltage in the liquid crystal capacitance Ccl. For example, a TFT with an oxide semiconductor used in a channel layer (referred to below as an "oxide TFT") is used as a TFT 16. More specifically, the channel layer of the TFT 16 is formed of InGaZnOx, which is mainly composed of indium (In), gallium (Ga), zinc (Zn), and oxygen (O). In the following, such a TFT with InGaZnOx used in a channel layer will be referred to as an "IGZO-TFT".

Figure 4:
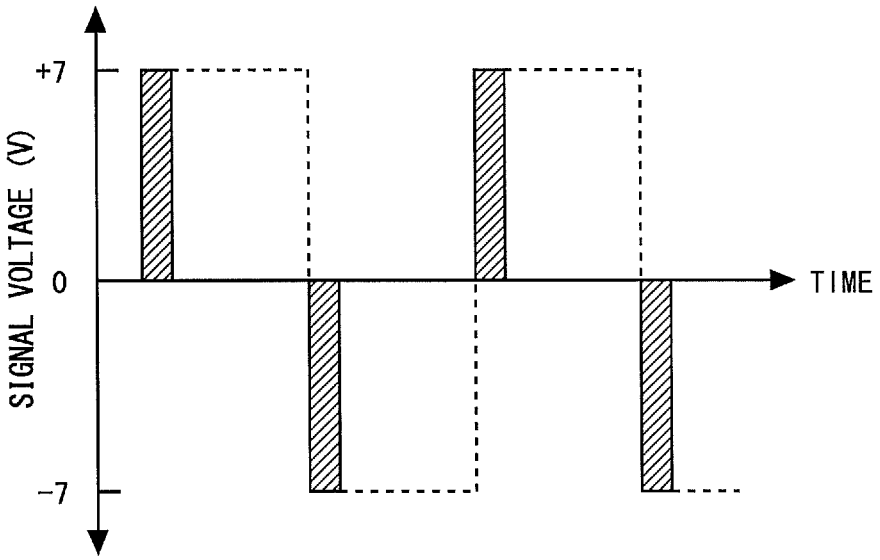
FIG. 4 is a diagram showing temporal changes in a signal voltage written in liquid crystal capacitance where IGZO-TFTs are used as switching elements of the pixel forming portions in the liquid crystal display device shown in FIG. 1.

FIG. 4 is a diagram showing temporal changes in a signal voltage written in the liquid crystal capacitance Ccl where IGZO-TFTs 16 are used as the switching elements of the pixel forming portions 15 in the liquid crystal display device 100. As shown in FIG. 4, a signal voltage of the positive polarity (e.g., +7V) is written, and the written voltage is maintained for a predetermined period of time. Next, a signal voltage of the negative polarity (e.g., −7V) is written, and the written voltage is maintained for a predetermined period of time. Even after these operations are repeated, the signal voltage written in the liquid crystal capacitance Ccl barely changes. Accordingly, it can be appreciated that the IGZO-TFT 16 offers extremely low off-leakage current, and the signal voltage written in the liquid crystal capacitance Ccl is maintained for a long period of time. In this manner, by using the IGZO-TFT 16 as the switching element of the pixel forming portion 15, it is rendered possible to perform multitone display even during pause drive.

Note that similar effects can be achieved even in the case where an oxide semiconductor, other than InGaZnOx, which includes, for example, at least one of the following: indium; gallium; zinc; copper (Cu); silicon (Si); tin (Sn); aluminum (Al); calcium (Ca); germanium (Ge); and lead (Pb), is used in a channel layer.

<1.3 Operation During Pause Drive>

Figure 5:
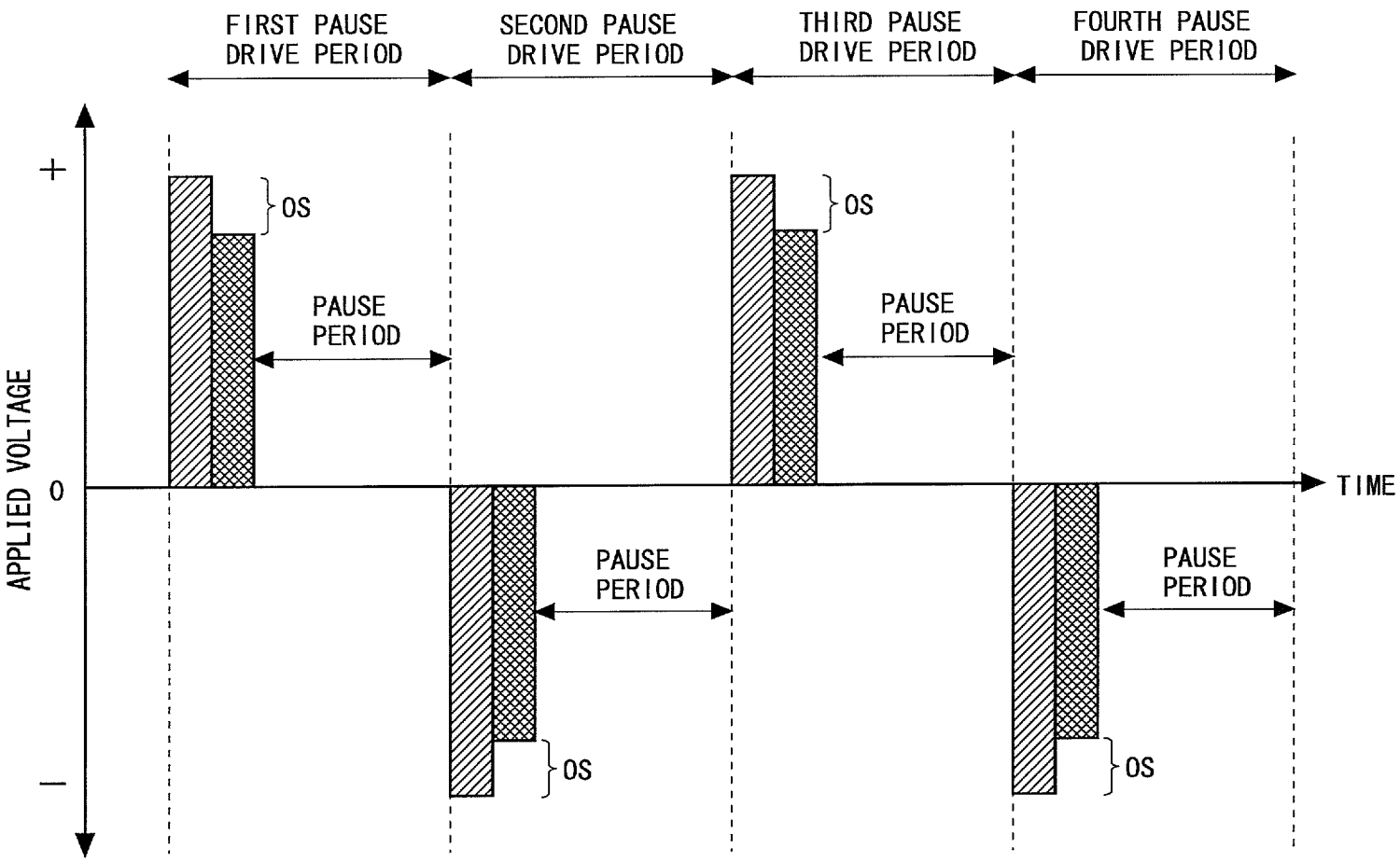
FIG. 5 is a diagram describing pause drive by the liquid crystal display device shown in FIG. 1.

FIG. 5 is a diagram describing pause drive by the liquid crystal display device 100. The liquid crystal display device 100 repeats the drive period and the pause period alternatingly, thereby driving the liquid crystal panel 10. In the drive period, the pause drive control circuit 31 outputs an active amplifier enable signal to the data signal line driver circuit 25, and overshoot voltages and signal voltages are written to the data signal lines SL. In the pause period, the pause drive control circuit 31 outputs an inactive amplifier enable signal to the data signal line driver circuit 25, thereby stopping the operation of the data signal line driver circuit 25 and/or the scanning signal line driver circuit 20. Note that the drive period herein is divided into a first drive period in which overshoot voltages are written and a second drive period in which signal voltages are written. Moreover, each drive period is divided into first and second drive frames, and a frame in the pause period is referred to as a pause frame. The overshoot voltage and the signal voltage might be referred to simply as voltages when they are not distinguished.

As shown in FIG. 5, the pause period and the drive period are set so as to alternate with each other, and one drive period and an immediately succeeding pause period are collectively referred to as a pause drive period. The polarity of signal voltages written to the data signal lines SL is inverted every pause drive period, so that as shown in FIG. 5, the polarity of the voltages is positive during odd pause drive periods and negative during even pause drive periods.

In FIG. 5, the grayscale value for the input image signal is always constant during each pause drive period. This is because it is taken into consideration that the images displayed on the liquid crystal panel 10 by pause drive are mostly still images. Note that the present invention is not limited by still images, and may be applicable to any images suitable for pause drive.

The first and second drive frames are set consecutively within a drive period of the first pause drive period. In the first drive frame, the comparator circuit 80 obtains a grayscale value for an externally provided input image signal (i.e., a grayscale value for the current frame) and a grayscale value stored in the frame memory 60 for an input image signal provided during the immediately previous frame period (i.e., a grayscale value for the previous period), and provides the results to the LUT 70. The LUT 70 outputs a correction value, which is correlated with the combination of the grayscale values for the previous and current frames, to the adder circuit 50. The adder circuit 50 adds the correction value provided by the LUT 70 to the grayscale value for the current frame for the input image signal provided by the frame memory 60, thereby generating a corrected image signal, and outputs the generated signal to the data signal line driver circuit 25. The corrected image signal is converted to overshoot voltages, which are higher than a voltage corresponding to the input image signal by the correction value (denoted by "OS" in FIG. 5), and the overshoot voltages are written to the data signal lines SL. The polarity of the overshoot voltages is positive. As a result, overshoot drive for the first pause drive period is performed.

In the second drive frame, the frame memory 60 has stored therein the same input image signal as that used in the first drive frame. The frame memory 60 provides the input image signal stored therein to the adder circuit 50. The adder circuit 50 outputs the provided input image signal to the data signal line driver circuit 25 as an image signal without addition of a correction value. The image signal is written to the data signal lines SL after conversion to analog signal voltages, which are voltages corresponding to the input image signal. Such drive as above is referred to herein as "normal drive". The polarity of the signal voltages is also positive. As a result, an image desired to be displayed during the first pause drive period is displayed on the liquid crystal panel 10.

In this manner, during the first drive frame, overshoot drive is performed using a correction value provided by the LUT 70, and during the immediately succeeding second drive frame, normal drive is performed so that signal voltages of the positive polarity are written to the data signal lines SL. Thereafter, a pause period in which an image written by normal drive is displayed continues until the start of a drive period in the second pause drive period.

The first and second drive frames are set consecutively also within each drive period of the second pause drive period. In this case, as in the first pause drive period, overshoot drive is performed during the first drive frame using a correction value provided by the LUT 70, and normal drive is performed during the second drive frame. However, unlike in the first pause drive period, the polarities of both the overshoot voltage and the signal voltage are negative during the first and second drive frames. Thereafter, a pause period in which an image written by normal drive is displayed continues until the start of a drive period in the third pause drive period.

<1.4 Effects>

Figure 6:
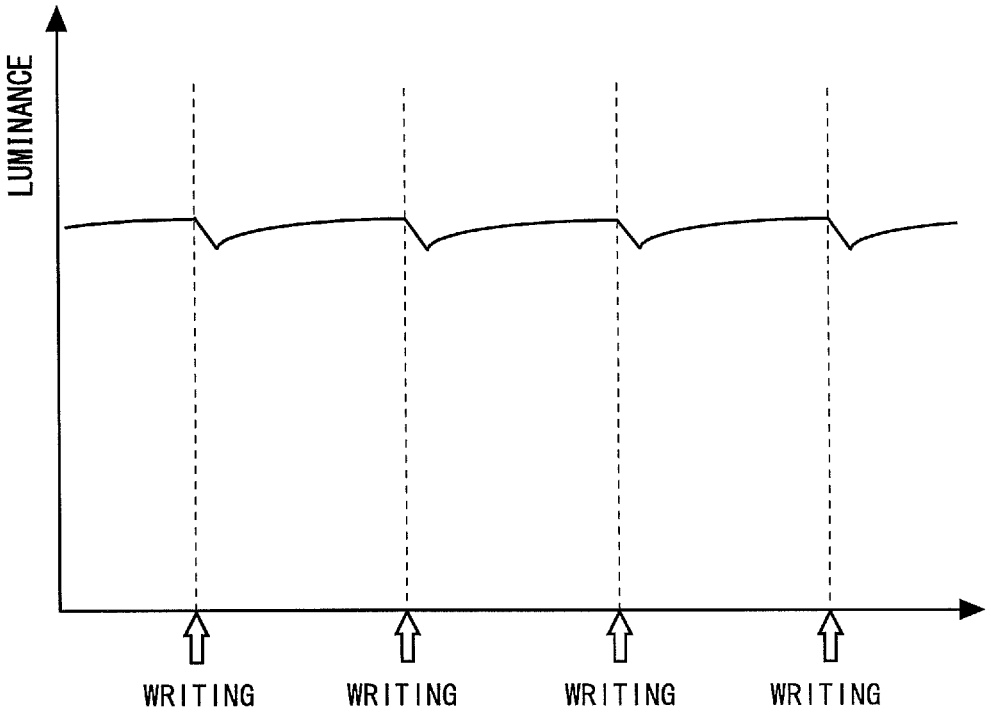
FIG. 6 is a diagram showing changes in luminance where pause drive is performed on the liquid crystal display device shown in FIG. 1.
Figure 31:
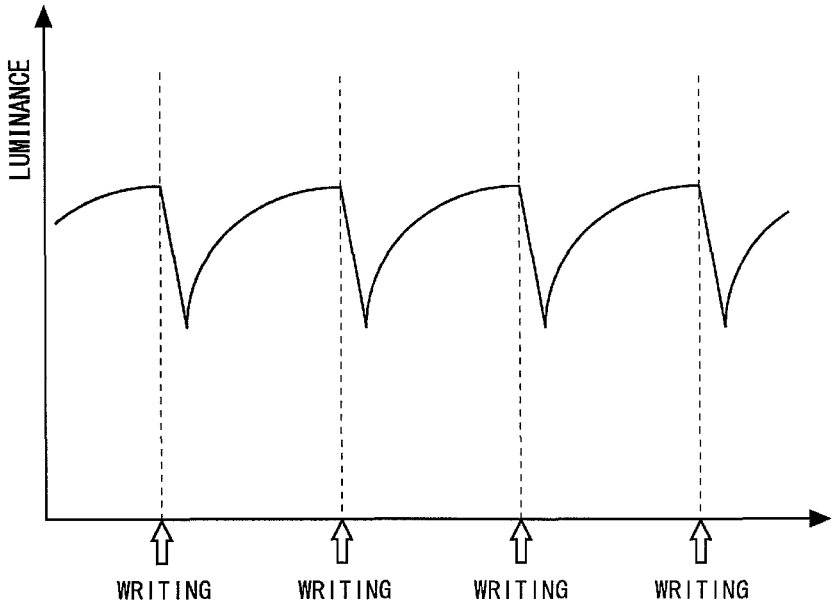
FIG. 31 PRIOR ART
FIG. 31 is a diagram schematically illustrating changes in luminance where pause drive is performed as shown in FIG. 30.

FIG. 6 is a diagram showing changes in luminance where pause drive is performed on the liquid crystal display device 100. When compared to FIG. 31 showing changes in luminance for a conventional case, it can be appreciated from FIG. 6 that a decrease in luminance immediately after signal voltages are written during a second drive period is suppressed significantly. As a result, flicker is almost unrecognizable by the viewer, so that the quality of an image displayed on the liquid crystal panel 10 is improved.

Note that normal drive is performed after overshoot drive, and therefore, the signal voltages written to the data signal lines SL at the end of the drive period have voltage values corresponding to the input image signal. Moreover, the IGZO-TFT 6, which offers very low off-leakage current, is used as the switching element of the pixel forming portion 15. Accordingly, the luminance that has decreased immediately after the writing of the signal voltages returns to its original value during the following pause period.

<1.5 First Variant>

In the above embodiment, both overshoot drive and normal drive are performed once during the drive period, and they are performed in succession. However, three or more drive frames may be set to extend the drive period so that overshoot drive is performed more than once, and thereafter, normal drive is performed once.

Figure 7:
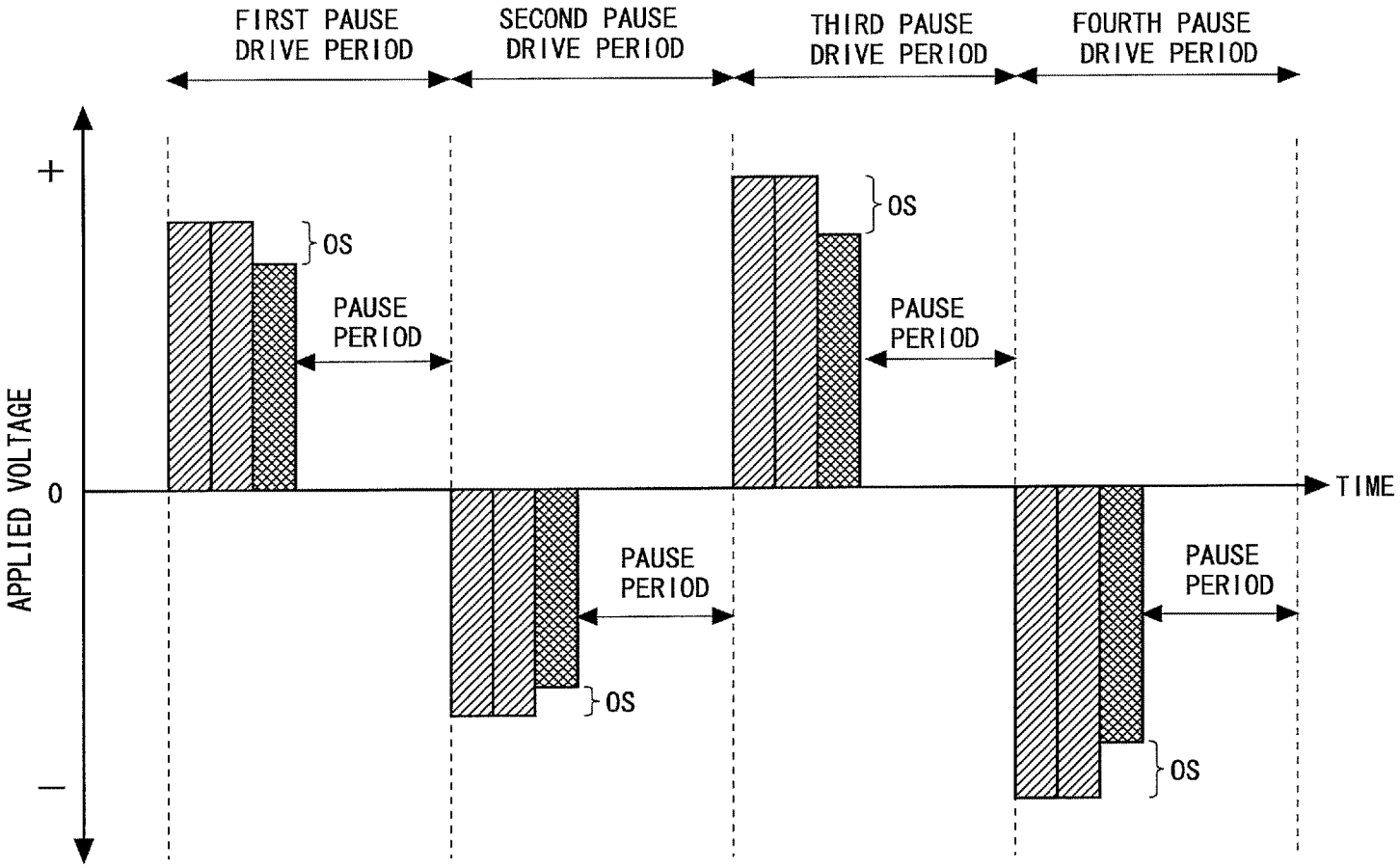
FIG. 7 is a diagram describing pause drive by a liquid crystal display device according to a first variant of the liquid crystal display device shown in FIG. 1.

The configuration of a liquid crystal display device according to a first variant of the present embodiment is the same as that shown in FIG. 1, and therefore, a block diagram and descriptions thereof will be omitted. FIG. 7 is a diagram describing pause drive in the present variant. As shown in FIG. 7, overshoot drive is performed twice in succession during a drive period in a first pause drive period, and then, normal drive is performed once.

In this manner, overshoot drive is performed twice in succession during a drive period within each pause drive period, and therefore, even in the case of liquid crystals with a slow response speed, liquid crystal molecules can be reliably oriented in the same direction as applied voltages. Note that in the present variant, overshoot drive is set to be performed twice, but it may be performed three or more times if the response speed of the liquid crystal is slower.

Figure 8:
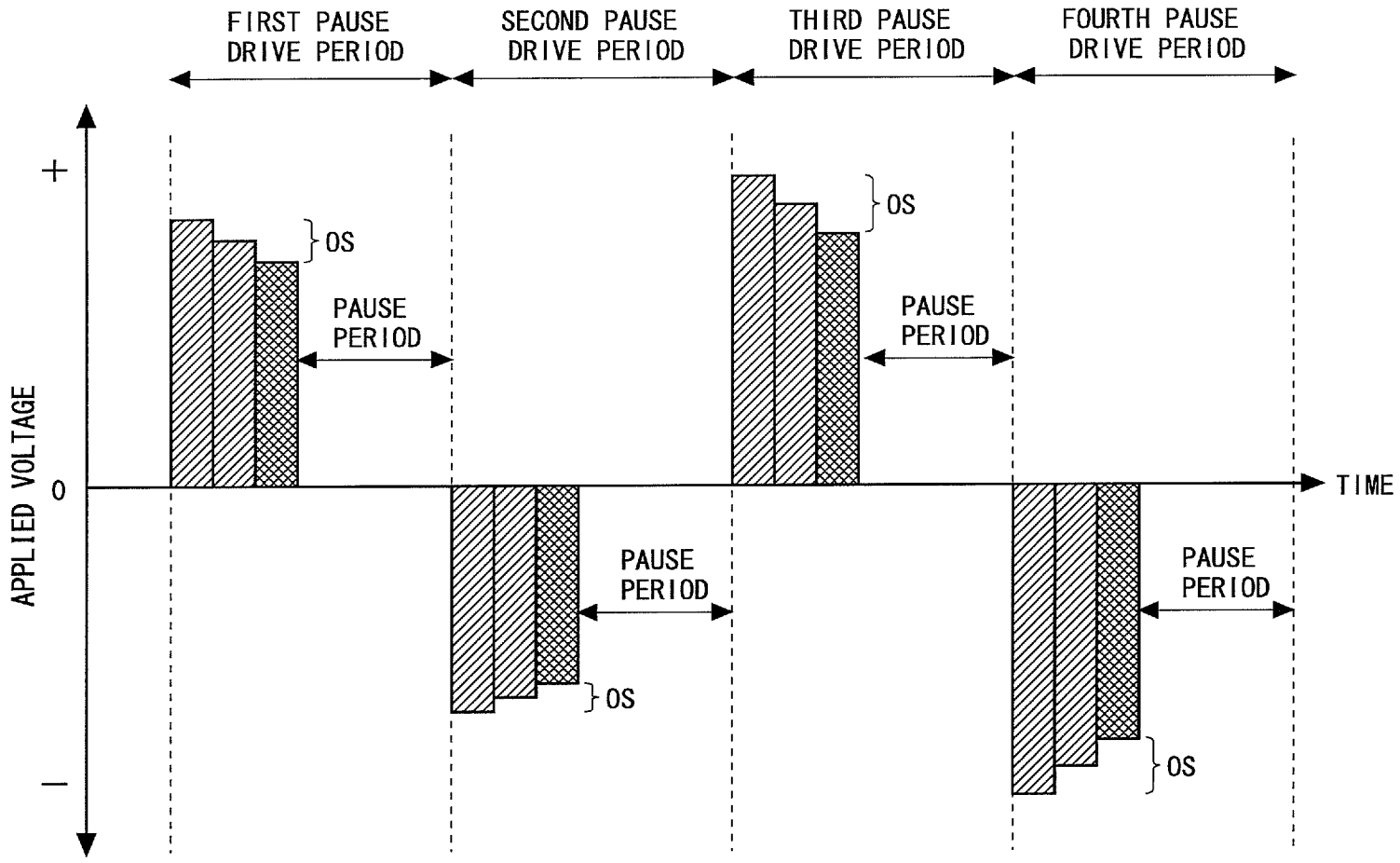
FIG. 8 is a diagram describing another type of pause drive by the liquid crystal display device according to the first variant of the liquid crystal display device shown in FIG. 1.

Furthermore, in the case of the overshoot drive shown in FIG. 7, the values for the overshoot voltages to be written at the two consecutive performances of overshoot drive are the same. However, these voltage values may be different, and for example, overshoot drive may be performed by writing overshoot voltages whose values decrease gradually, as shown in FIG. 8.

Note that in any of the cases, it is necessary to display an image corresponding to an input image signal during the pause period, and therefore, normal drive in which signal voltages whose values correspond to the input image signal are written is performed in the last drive frame of the drive period.

<1.6 Second Variant>

In the above embodiment, the TFT of the pixel forming portion 15 is the IGZO-TFT 16. However, it may be a TFT whose channel layer is made of amorphous silicon (Si) or polycrystalline silicon. In the following, the TFT whose channel layer is made of amorphous silicon will be referred to as an "a-TFT", and the TFT whose channel layer is made of polycrystalline silicon will be referred to as a "p-TFT". When compared to the IGZO-TFT, the a-TFT and the p-TFT offer very high off-leakage current. Therefore, the signal voltage written in the liquid crystal capacitance Ccl falls in a short period of time.

Therefore, a second variant of the present embodiment will be described with respect to a liquid crystal display device in which the a-TFTs or the p-TFTs are used as the switching elements of the pixel forming portions 15. The configuration of the liquid crystal display device is the same as that of the liquid crystal display device 100 shown in FIG. 1, except that the a-TFTs or the p-TFTs are used in place of InGaZnOx, and therefore, any description and block diagram thereof will be omitted.

Figure 9:
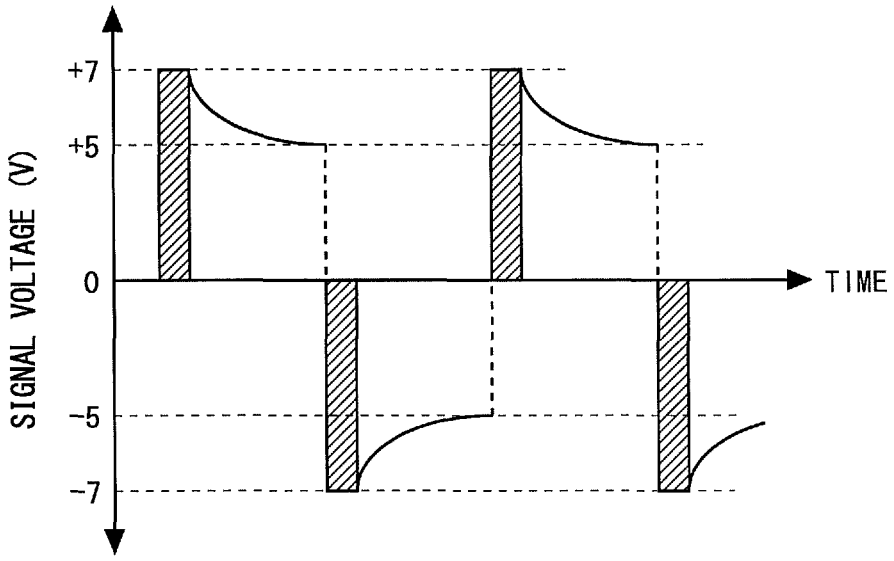
FIG. 9 is a diagram showing temporal changes in a signal voltage written in liquid crystal capacitance where a-TFTs are used as switching elements of pixel forming portions in a liquid crystal display device according to a second variant of the liquid crystal display device shown in FIG. 1.

FIG. 9 is a diagram showing temporal changes in the signal voltage written in the liquid crystal capacitance where the a-TFTs are used as the switching elements of the pixel forming portions 15 in the present variant. As shown in FIG. 9, a signal voltage of the positive polarity (e.g., +7V) is written, and the a-TFT is turned off to maintain the written voltage for a predetermined period of time. Next, a signal voltage of the negative polarity (e.g., −7V) is written, and the a-TFT is turned off to maintain the written voltage for a predetermined period of time. These operations will be repeated. Since the a-TFT offers high off-leakage current, the value for the signal voltage falls to +5V during the pause period when the signal voltage of +7V is written as above or rises to −5V during the pause period when the signal voltage of −7V is written as above.

Figure 10:
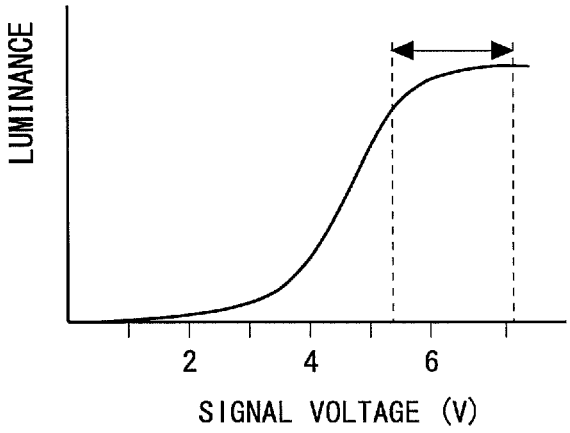
FIG. 10 is a diagram showing the relationship between signal voltage and luminance where a-TFTs are used as the switching elements of the pixel forming portions in the liquid crystal display device according to the second variant of the liquid crystal display device shown in FIG. 1.

However, in the liquid crystal display device using the a-TFTs, the luminance is low when the signal voltage is low, but the luminance increases sharply as the signal voltage rises, as shown in FIG. 10. In addition, the luminance is approximately constant when the signal voltage is about 5 to 7V. According to these results, the liquid crystal display device using the a-TFTs is not suitable for displaying a multitone image as liquid crystal display devices using IGZO-TFTs do, but it is capable of displaying an image, such as a black-and-white image, which can be displayed with two luminance values. Furthermore, by forming RGB color filters to the surface of the liquid crystal panel, it is rendered possible to display an image represented by nine colors, including black.

Figure 11:
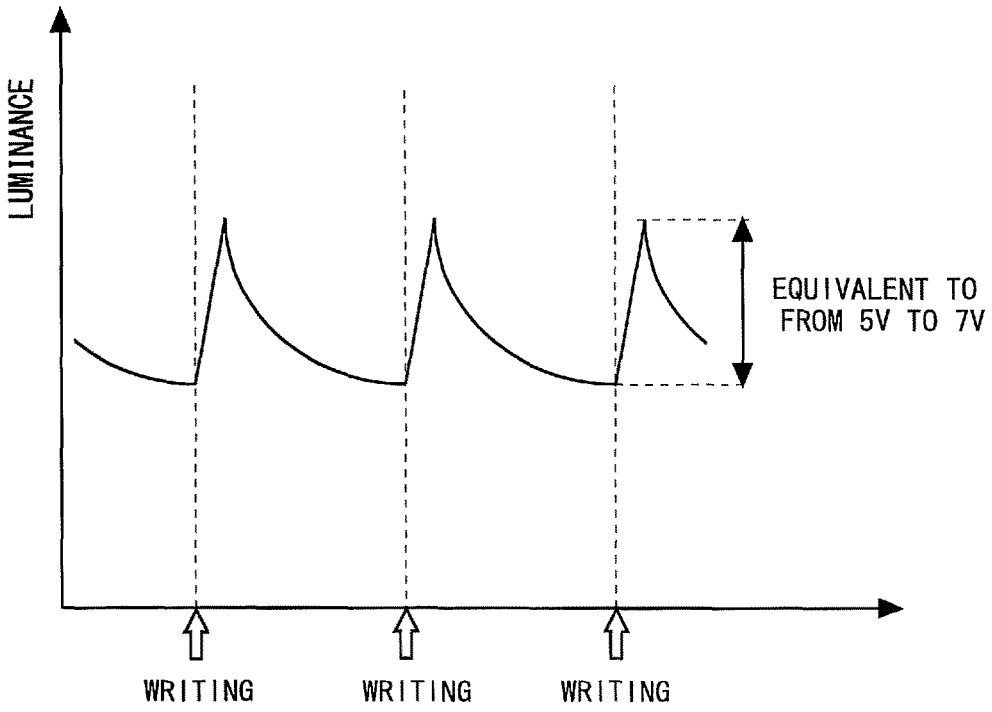
FIG. 11 is a diagram schematically showing changes in luminance where a-TFTs are used as the switching elements of the pixel forming portions in the liquid crystal display device according to the second variant of the first embodiment.

FIG. 11 is a diagram schematically showing changes in luminance where a-TFTs are used as the switching elements of the pixel forming portions in the present variant. Unlike in FIG. 31 where the IGZO-TFTs are used, the luminance increases when the signal voltage is written at the beginning of each pause drive period. However, thereafter, the written signal voltage falls because of the off-leakage current of the a-TFT, so that the luminance falls as well. By adjusting the pause period such that the next writing is performed when the signal voltage falls approximately 5V, the luminance is caused to rise again when the signal voltage is written during the next pause drive period. In this case, by keeping the change in the signal voltage within the range from 5V to 7V, it is rendered possible to control the luminance during each pause drive period within such a range that the luminance can be considered approximately constant. As a result, a liquid crystal display device which can be produced at low cost is allowed to display an image, such as a black-and-white image, which can be displayed with two luminance values. Note that the a-TFT or P-TFT encompasses any TFT whose channel layer is made of a semiconductor such as amorphous silicon-germanium (SiGe) or polycrystalline silicon-germanium.

2. Second Embodiment

<2.1 Configuration of the Liquid Crystal Display Device>

Figure 12:
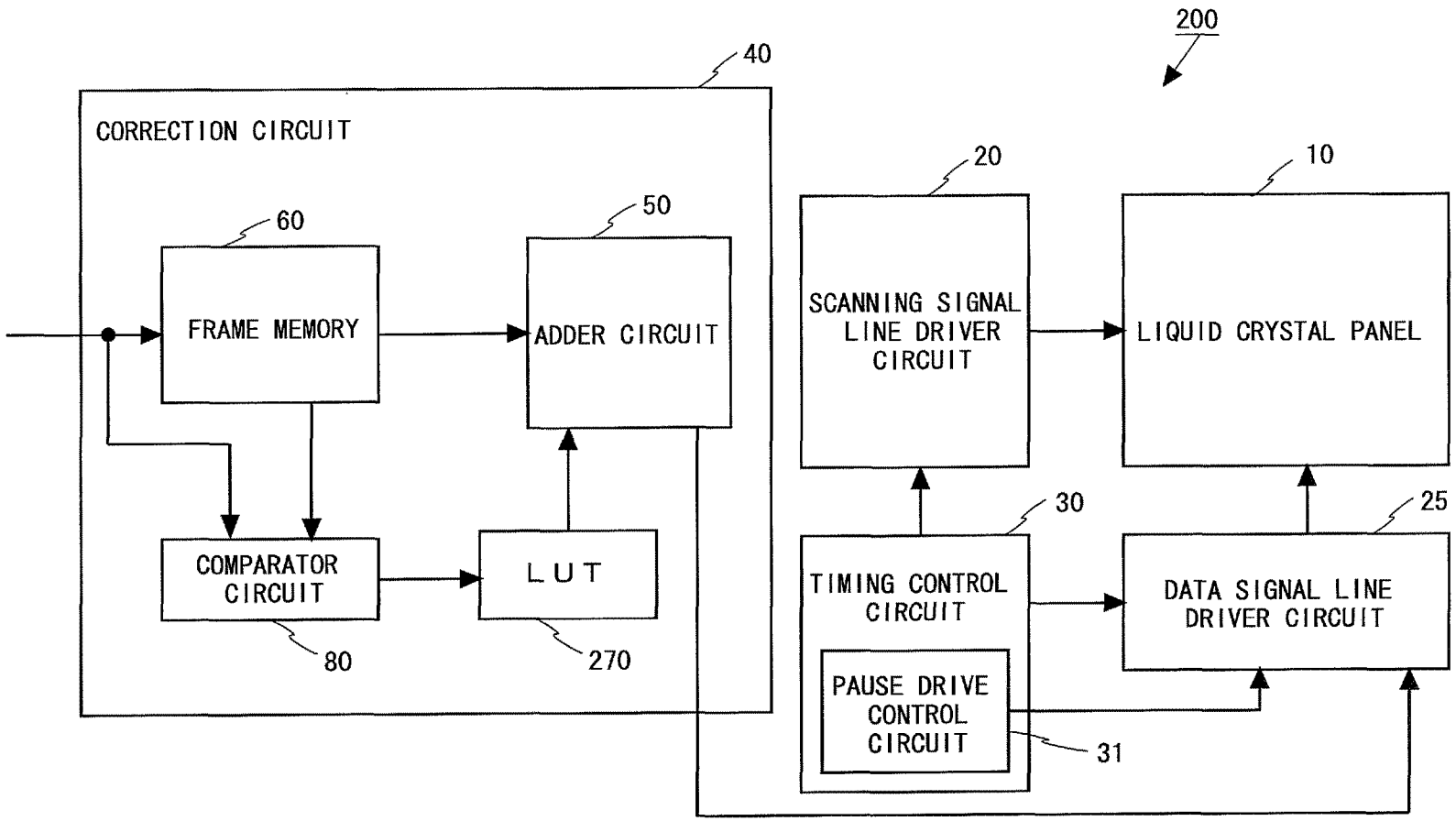
FIG. 12 is a block diagram illustrating the configuration of a liquid crystal display device according to a second embodiment of the present invention.

FIG. 12 is a block diagram illustrating the configuration of a liquid crystal display device 200 according to a second embodiment of the present invention capable of pause drive. As with the liquid crystal display device 100 shown in FIG. 1, the liquid crystal display device 200 shown in FIG. 12 includes a liquid crystal panel 10, a scanning signal line driver circuit 20, a data signal line driver circuit 25, a timing control circuit 30, and a correction circuit 40. Among these components, the correction circuit 40 differs in configuration from that shown in FIG. 1. Accordingly, in FIG. 12, the same components as those shown in FIG. 1 are denoted by the same reference characters as those assigned to the components shown in FIG. 1, any descriptions thereof will be omitted, and different components will be described mainly. As shown in FIG. 12, the liquid crystal display device 200 uses an LUT 270 to be described later, in place of the LUT 70 shown in FIG. 1.

FIG. 13 is a diagram showing an example of the configuration of the LUT 270 used in the liquid crystal display device 200. As shown in FIG. 13, the LUT 270 has stored therein correction values for emphasizing temporal changes in the input image signal, such that the correction values are only correlated with combinations of equal grayscale values for the previous and current frames. For example, as for the grayscale value "32" for the previous frame, only the correction value that corresponds to the grayscale value "32"

for the current frame is stored, and there are no correction values stored corresponding to other grayscale values.

Accordingly, only when the comparator circuit 80 determines that the grayscale values for the previous and current frames are equal, the comparator circuit 80 provides the result to the LUT 270. The LUT 270 provides the adder circuit 50 with a correction value corresponding to the grayscale value provided by the comparator circuit 80. The adder circuit 50 generates a corrected image signal by adding the correction value to the grayscale value for the current frame, and outputs the generated signal to the data signal line driver circuit 25.

On the other hand, when the comparator circuit 80 determines that the grayscale values for the previous and current frames are not equal, the comparator circuit 80 does not provide the result to the LUT 270. Accordingly, the adder circuit 50 outputs the grayscale value for the current frame to the data signal line driver circuit 25 as an image signal without adding a correction value to the grayscale value for the current frame.

Note that in the present embodiment, the wording that the grayscale values for the previous and current frames are equal encompasses not only the case where the grayscale values for both are completely equal but also the case where the grayscale values for both are essentially equal. Herein, the grayscale values that are essentially equal include grayscale values in the range of ±8 with respect to the grayscale values listed in the LUT 270. For example, when the grayscale value for one frame is 32, the grayscale values in the range from 24 to 40 for the other frame are considered essentially equal to the grayscale value "32" for the former frame. Accordingly, in the case where the grayscale value for the previous frame is 28, and the grayscale value for the current frame is 36, both are considered essentially equal, and the adder circuit 50 adds 5, which is the correction value in the LUT 270 that corresponds to the grayscale value "32" for both the previous and current frames, to the grayscale value for the current frame.

<2.2 Operation During Pause Drive>

Figure 14:
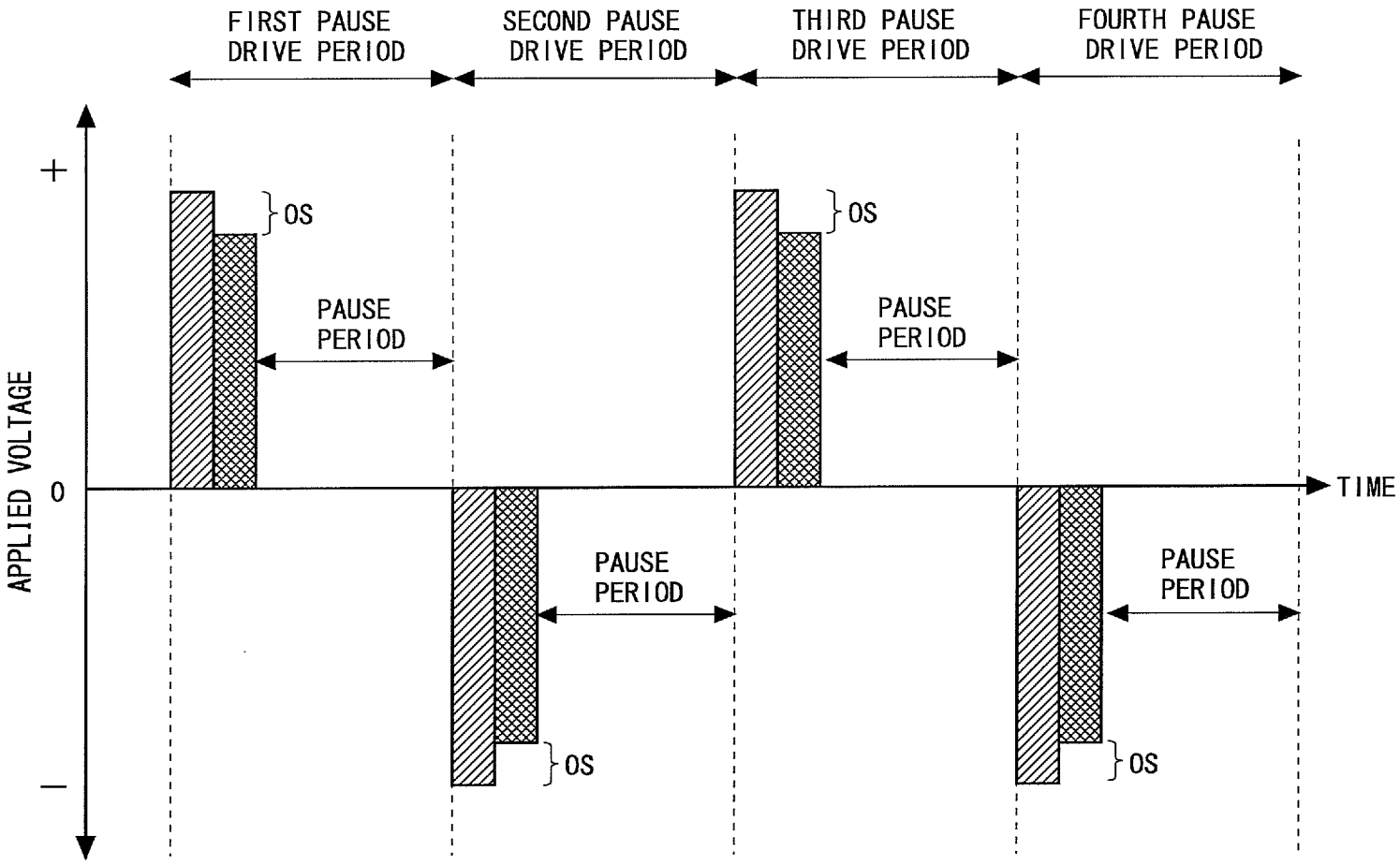
FIG. 14 is a diagram describing pause drive in the liquid crystal display device shown in FIG. 12 where grayscale values for previous and current frames are the same.
Figure 15:
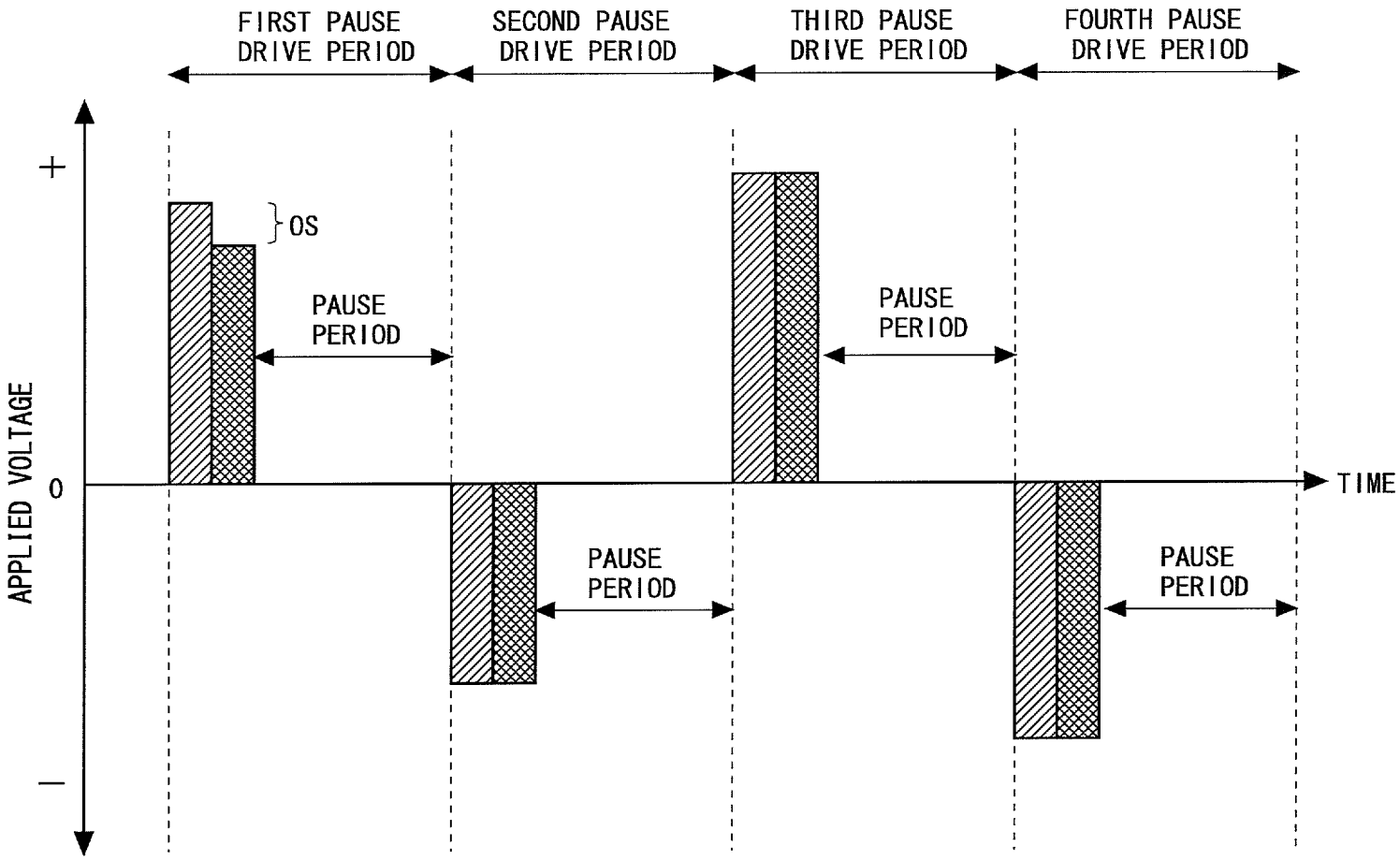
FIG. 15 is a diagram describing pause drive in the liquid crystal display device shown in FIG. 12 where the grayscale values for the previous and current frames are different.

FIG. 14 is a diagram describing pause drive in the present embodiment where the grayscale values for the previous and current frames are the same, and FIG. 15 is a diagram describing pause drive where the grayscale values for the previous and current frames are different. The pause drive shown in FIG. 14 is the same as that described in the first embodiment, and therefore, any description thereof will be omitted.

In the case where the grayscale values for the previous and current frames are different, also, first and second drive frames are set consecutively within a drive period of a first pause drive period, as shown in FIG. 15. In the first drive frame, the grayscale values for the previous and current frames are the same, and therefore, a corresponding correction value in the LUT 270 is provided to the adder circuit 50. The adder circuit 50 generates a corrected image signal by adding the correction value to the grayscale value for an input image signal provided by the frame memory 60 (i.e., the grayscale value for the current frame), and outputs the generated signal to the data signal line driver circuit 25. The corrected image signal is written to the data signal lines SL after conversion to overshoot voltages higher than a voltage that corresponds to the input image signal. As a result, overshoot drive is performed. Note that the polarity of the overshoot drive voltages is positive.

In the second drive frame, the frame memory 60 has stored therein the same input image signal as that used in the first drive frame. When the adder circuit 50 is provided with the input image signal from the frame memory 60, the adder circuit 50 outputs the signal to the data signal line driver circuit 25 as an image signal without addition of a correction value. The image signal is written to the data signal lines SL after conversion to signal voltages with values corresponding to the input image. The polarity of the signal voltages is also positive.

In this manner, in the first pause drive period, overshoot drive is performed first, and thereafter, normal drive is performed. When the signal voltages of the positive polarity are written to the data signal lines SL, a pause period in which an image written by normal drive is displayed continues thereafter until the start of a drive period in the second pause drive period.

In the drive period of the second pause drive period, unlike in the first pause drive period, the grayscale values for the previous and current frames are different. Accordingly, when the adder circuit 50 is provided with the input image signal from the frame memory 60 in the first drive frame, the adder circuit 50 outputs the signal without addition of a correction value. As a result, overshoot drive is not performed. In the second drive frame also, when the input image signal from the frame memory 60 is provided, the signal is outputted to the data signal line driver circuit 25 as an image signal without addition of a correction value. The image signal is written to the data signal lines SL after conversion to signal voltages with values corresponding to the input image signal. In this manner, the voltages with the same values are outputted in the first and second drive frames, and therefore, the result is the same as if normal drive were performed twice. Note that the polarity of these voltages is negative.

Thereafter, similarly, in each odd pause drive period, normal drive in which signal voltages of the positive polarity are written without addition of a correction value is performed twice in succession and followed by a pause period. Moreover, in each even pause drive period, normal drive is performed twice in succession by writing signal voltages of the negative polarity without addition of a correction value, and followed by a pause period.

Note that in the case where the response speed of the liquid crystal is fast, if the grayscale values for the previous and current frames are different, the first and second drive frames are not set in succession, and only the first drive frame may be set so as to be followed by a pause period rather than by the second drive frame. Setting no second drive frame reduces power consumption by the liquid crystal display device.

<2.3 Effects>

Flicker is recognizable when the same image continues to be displayed. Accordingly, in the present embodiment, overshoot drive is performed only when images with essentially the same grayscale value are displayed in succession, and thereafter, normal drive is performed. This allows the viewer to barely recognize flicker. Moreover, in the case where images with essentially different grayscale values are displayed in succession, even if flicker occurs because of a decrease in luminance, the viewer barely recognizes such flicker. Therefore, normal drive is performed twice without overshoot drive being performed. This allows a reduction in the size of the LUT 270, resulting in reduced cost of the liquid crystal display device 200.

<2.4 First Variant>

Figure 16:
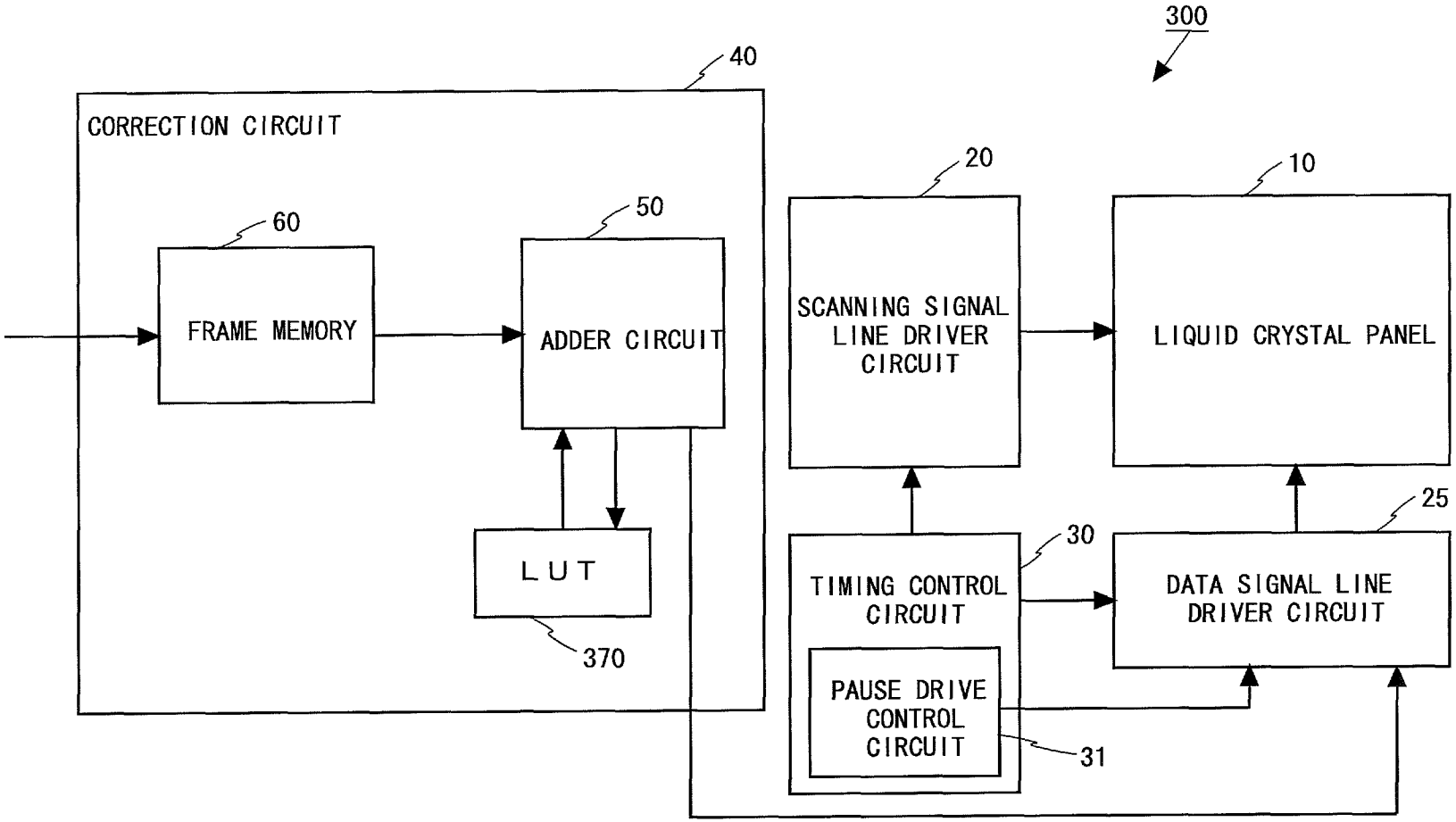
FIG. 16 is a block diagram of a liquid crystal display device according to a first variant of the second embodiment of the present invention.

FIG. 16 is a block diagram of a liquid crystal display device 300 according to a first variant of the present embodiment. As with the liquid crystal display device 100 shown in FIG. 1, the liquid crystal display device 300 shown in FIG.

16 includes a liquid crystal panel 10, a scanning signal line driver circuit 20, a data signal line driver circuit 25, a timing control circuit 30, and a correction circuit 40. Among these components, the correction circuit 40 differs in configuration from that shown in FIG. 1. Accordingly, in FIG. 16, the same components as those shown in FIG. 1 are denoted by the same reference characters as those assigned to the components shown in FIG. 1, any descriptions thereof will be omitted, and different components will be described mainly.

As shown in FIG. 16, the correction circuit 40 includes frame memory 60, an adder circuit 50, and an LUT 70, but does not include any comparator circuit. The reason why no comparator circuit is provided in the present variant is that there is no need to determine whether the grayscale values for the previous and current frames are equal. FIG. 17 is a diagram showing an example of the configuration of an LUT 370 used in the present variant. Unlike the LUT 70 shown in FIG. 2, the LUT 370 has only stored therein correction values corresponding to grayscale values for the current frame. In this manner, the correction value is determined by the grayscale value for the current frame, regardless of the grayscale value for the previous frame.

Accordingly, unlike in the second embodiment, the adder circuit 50 generates a corrected image signal by adding correction values stored in the LUT 370 to all grayscale values for the current frame, regardless of grayscale values for the previous frame, and outputs the generated signal to the data signal line driver circuit 25.

<2.4.1 Operation During Pause Drive>

Figure 18:
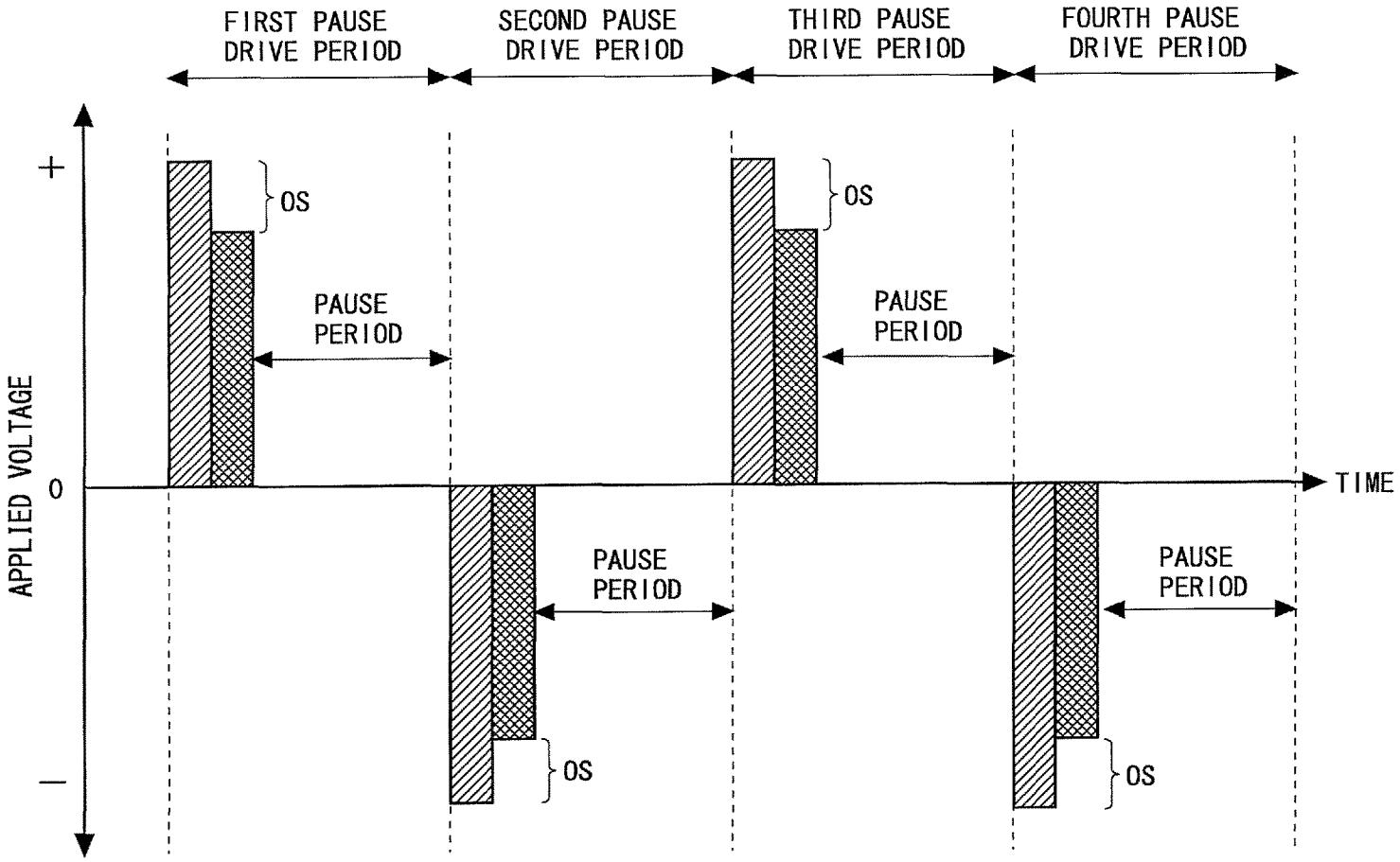
FIG. 18 is a diagram describing pause drive in the liquid crystal display device shown in FIG. 16 where grayscale values for previous and current frames are the same.
Figure 19:
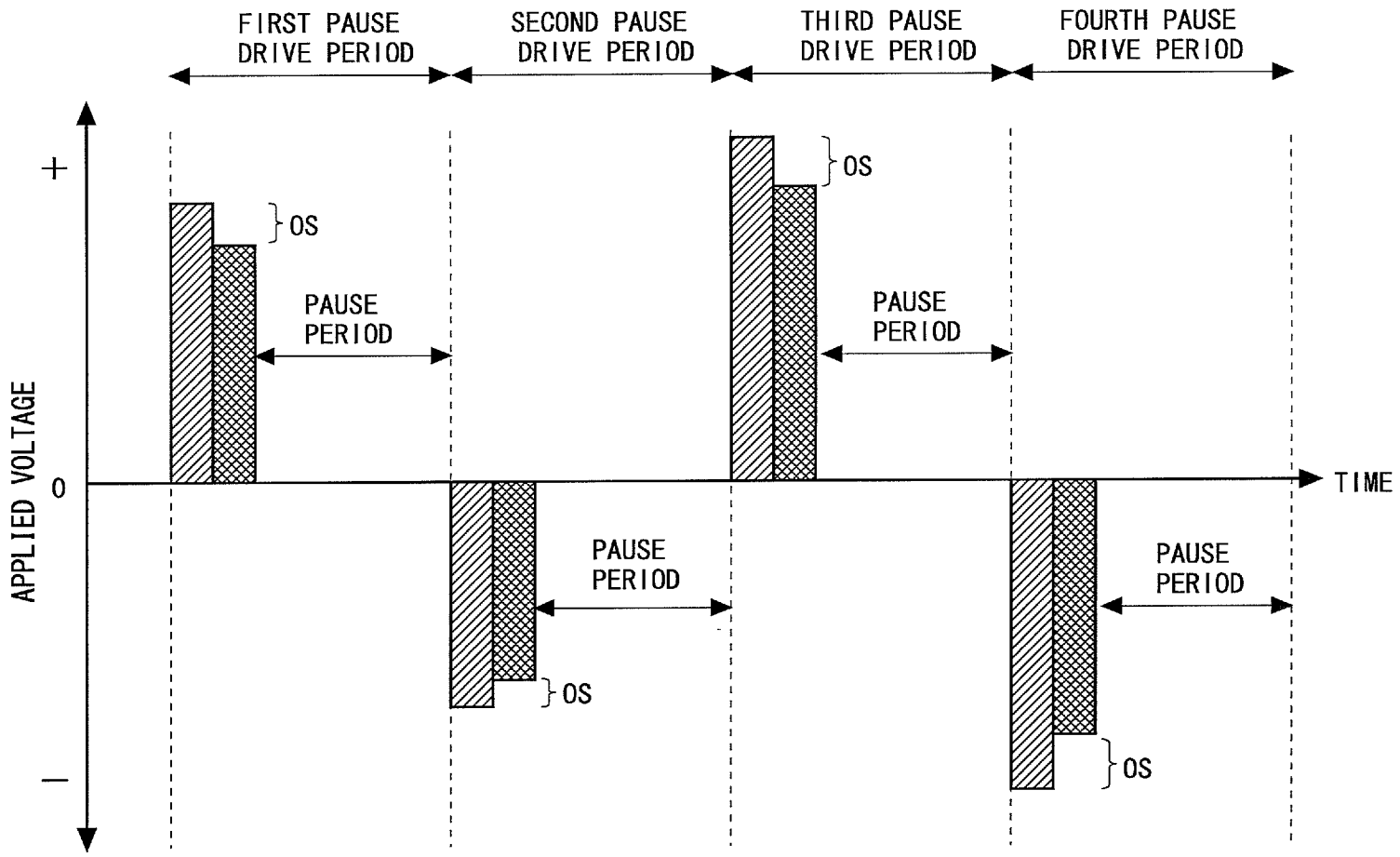
FIG. 19 is a diagram describing pause drive in the liquid crystal display device shown in FIG. 16 where the grayscale values for the previous and current frames are different.

FIG. 18 is a diagram describing pause drive where the grayscale values for the previous and current frames are the same, and FIG. 19 is a diagram describing pause drive where the grayscale values for the previous and current frames are different.

In any of the cases, first and second drive frames are set consecutively within a drive period of a first pause drive period. In the first drive frame, when the adder circuit 50 is provided with a correction value from the LUT 370 which corresponds to a grayscale value for an input image signal provided by the frame memory 60 (i.e., a grayscale value for the current frame), the adder circuit 50 generates a corrected image signal by adding the correction value to the grayscale value for the current frame, and outputs the generated signal to the data signal line driver circuit 25. The corrected image signal is written to the data signal lines SL after conversion to overshoot voltages higher than the voltage that corresponds to the input image signal. The polarity of the analog signal voltages is positive. As a result, overshoot drive is performed.

In the second drive frame, the frame memory 60 has stored therein the same input image signal as that used in the first drive frame. When the adder circuit 50 is provided with the input image signal from the frame memory 60, the adder circuit 50 outputs the signal to the data signal line driver circuit 25 as an image signal without addition of a correction value. The image signal is written to the data signal lines SL after conversion to signal voltages corresponding to the input image signal. The polarity of the analog signal voltages is also positive. As a result, normal drive is performed.

In this manner, in the first drive frame, overshoot drive is performed using the correction value provided by the LUT 370, and in the second drive frame, normal drive is performed so that signal voltages of the positive polarity are written to the data signal lines SL. Thereafter, a pause period in which an image written by normal drive is displayed continues until the start of a drive period in the second pause drive period.

In the drive period of the second pause drive period also, first and second drive frames are set consecutively. In this case, as in the first pause drive period, overshoot drive is performed in the first drive frame in accordance with a corrected image signal obtained by adding a correction value provided by the LUT 370 to the grayscale value for the current frame, and normal drive is performed in the second drive frame. However, in any of the drive frames, voltages of the negative polarity are written. Thereafter, a pause period in which an image written by normal drive is displayed continues until the start of a drive period in the third pause drive period.

Thereafter, similarly, in each odd pause drive period, overshoot drive is performed by writing overshoot voltages of the positive polarity. Then, normal drive is performed by writing signal voltages of the positive polarity, and followed by a pause period. Moreover, in each even pause drive period, overshoot drive is performed by writing overshoot voltages of the negative polarity. Then, normal drive is performed by writing signal voltages of the negative polarity, and followed by a pause period.

In this manner, in the present variant, regardless of whether the grayscale values for the previous and current frames are equal, overshoot drive is performed only on the basis of the grayscale value for the current frame. Accordingly, in the present variant, unlike in the second embodiment, it is necessary to always perform normal drive in the second drive frame, and the second drive frame cannot be omitted.

<2.4.2 Effects>

The present variant achieves the same effects as those achieved by the second embodiment, and further, eliminates the need to provide any comparator circuit because there is no need to determine whether the grayscale values for the previous and current frames are the same. Thus, the production cost for the liquid crystal display device 300 can be further reduced.

<2.5 Second Variant>

In the first variant, the amount of correction stored in the LUT 370 is the same between the case where the polarity of the input image signal changes from positive to negative and the case where the polarity changes from negative to positive.

However, the direction in which liquid crystal molecules tend or do not tend to be oriented might depend on the direction of a voltage applied to the liquid crystal layer, and therefore, the response speed of the liquid crystal might vary among directions of applied voltages. In such a case, even if the grayscale values for the previous and current frames are the same, it is necessary to change the overshoot voltages in accordance with the direction of the applied voltage. Accordingly, the correction circuit of the liquid crystal display device is provided with an LUT (also referred to as a "first table") having correction values stored for one direction in which the voltage is applied, as well as an LUT (also referred to as a "second table") having correction values stored for the opposite direction. Note that configuration examples of the LUTs are omitted in the present variant.

Figure 20:
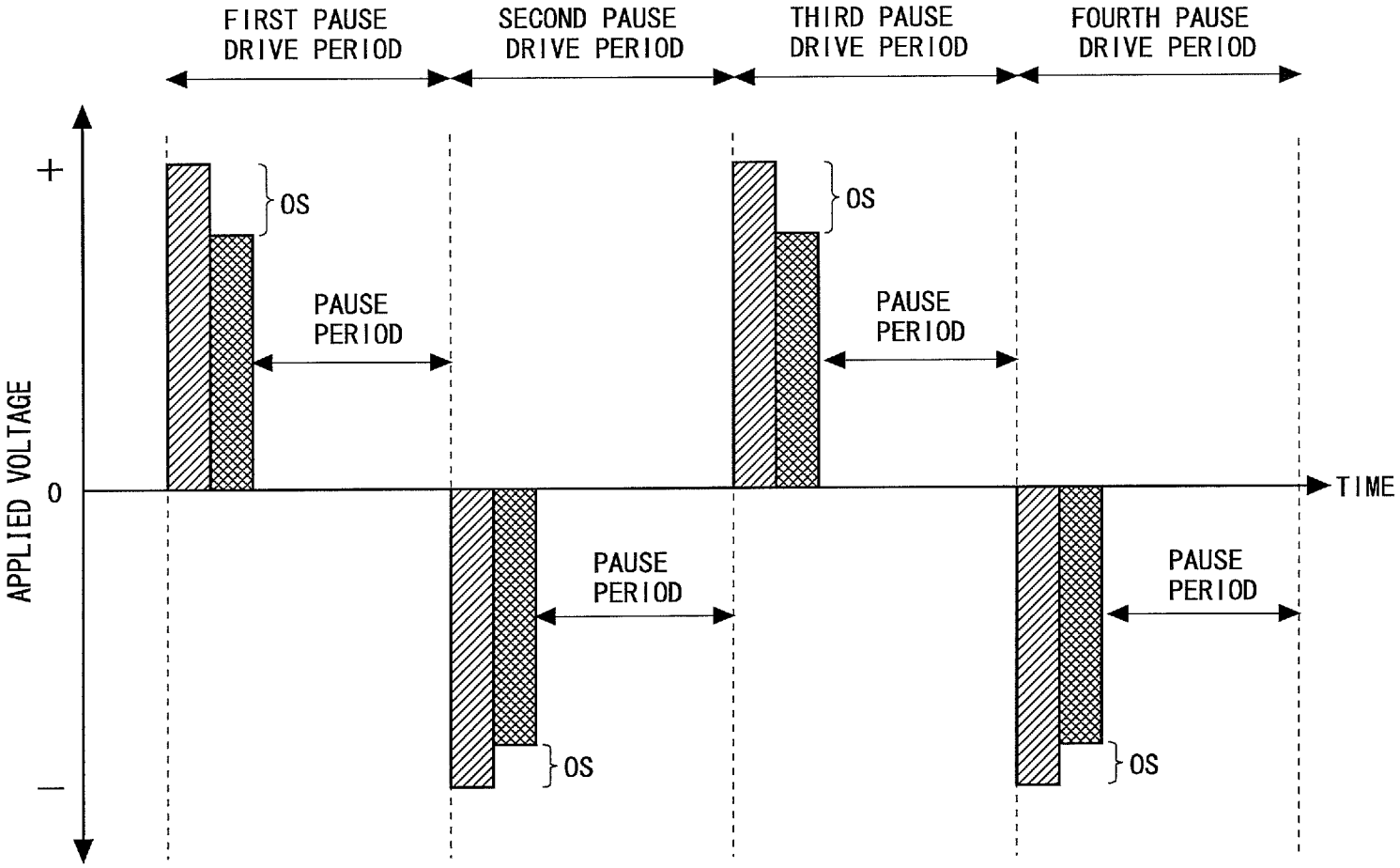
FIG. 20 is a diagram describing pause drive in a liquid crystal display device according to a second variant of the second embodiment of the present invention where grayscale values for previous and current frames are the same.

FIG. 20 is a diagram describing pause drive in the liquid crystal display device according to the present variant where the grayscale values for the previous and current frames are the same. Unlike in the case shown in FIG. 18, even when the grayscale values for the previous and current frames are equal, the overshoot voltages vary between the case where the polarity of the input image signal changes from positive to negative and the case where the polarity changes from negative to positive, and the voltage value is higher in the case where the polarity changes from negative to positive than in the opposite case. Such overshoot drive is performed by setting the correction values in the LUT used in the case where the polarity changes from negative to positive, higher than the correction values in the LUT used in the case where the polarity changes from positive to negative.

Accordingly, even if the response speed of the liquid crystal varies between the case where the polarity of the voltage applied to the liquid crystal layer changes from positive to negative and the case where the polarity changes from negative to positive, the decrease in luminance at the time of writing due to the direction of the applied voltage can be kept down to approximately the same level. Thus, the viewer barely recognizes flicker.

Note that the present variant can be applied similarly not only to the case where the grayscale values for the previous and current frames are the same but also to the case where they are different. In addition, even in the case where the voltage value is higher in the case where the polarity changes from positive to negative than in the case where the polarity changes in the opposite direction, drive can be performed in the same manner as in the present variant.

3. Third Embodiment

When the viscosity of the liquid crystal changes because of an ambient temperature change around the liquid crystal display device, the response speed of the liquid crystal display device changes conspicuously. Accordingly, if overshoot drive is performed at low temperature using an LUT having stored correction values set at room temperature, the response speed of the liquid crystal is slower at low temperature, and therefore, cannot be increased sufficiently, so that overshoot drive cannot achieve its full effect. On the other hand, if overshoot drive is performed at high temperature, overshoot drive brings an excessive effect, resulting in overly emphasized display. Therefore, liquid crystal display devices for use in a wide range of temperatures preferably have a plurality of LUTs so that optimized overshoot drive can be performed with addition of optimal correction values suitable for the temperature.

<3.1 Configuration of the Liquid Crystal Display Device>

Figure 21:
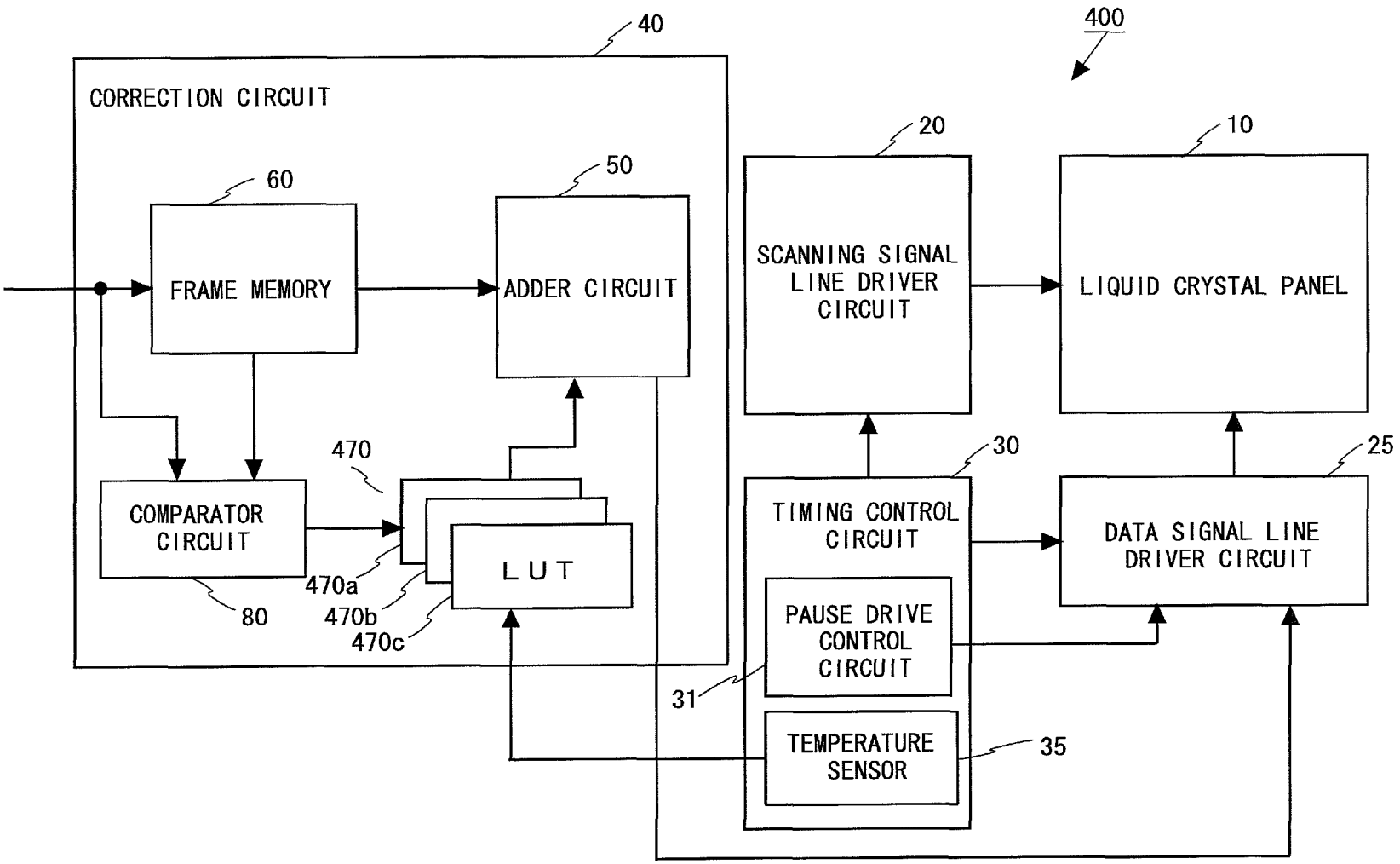
FIG. 21 is a block diagram of a liquid crystal display device according to a third embodiment of the present invention.

FIG. 21 is a block diagram of a liquid crystal display device 400 according to a third embodiment of the present invention. The liquid crystal display device 400 shown in FIG. 21 differs from the liquid crystal display device 100 shown in FIG. 1 in that a temperature sensor 35 is provided in the timing control circuit 30, and the correction circuit 40 has three LUTs 470. Note that in FIG. 21, the same components as those shown in FIG. 1 are denoted by the same reference characters as those assigned to the components shown in FIG. 1, any descriptions thereof will be omitted, and different components will be described mainly.

FIG. 22 is a diagram showing an LUT 470*a* for room temperature for use in the liquid crystal display device 400, FIG. 23 is a diagram showing an LUT 470*b* for high temperature, and FIG. 24 is a diagram showing an LUT 470*c* for low temperature. As can be appreciated from FIGS. 22 to 24, correction values are set so as to decrease in the order: the LUT 470*c* for low temperature, the LUT 470*a* for room temperature, and the LUT 470*b* for high temperature. From the above, it can be appreciated that overshoot drive at low temperature at which the response speed of the liquid crystal tends to decrease is emphasized most, and followed by overshoot at room temperature, and overshoot drive at high temperature is the least effective.

In this manner, the LUTs 470 to be used are switched in accordance with the temperature at which the liquid crystal display device 400 is used, and therefore, the temperature sensor 35 for acquiring temperature information is required. In the present embodiment, the temperature sensor 35 is provided in the timing control circuit 30, and one of the LUTs 470*a* to 470*c* is selected on the basis of temperature information from the temperature sensor 35. Once one of the LUTs 470*a* to 470*c* is selected, overshoot voltages are generated to perform overshoot drive as in the above embodiments.

Note that in the present embodiment, the LUT 470*a* for room temperature is used at 10° C. or higher but less than 40° C., the LUT 470*b* for high temperature is used at 40° C. or higher, and the LUT 470*c* for low temperature is used at less than 10° C., but it is possible to appropriately adjust the temperature ranges in which they can be used. In addition, the number of LUTs 470 is not limited to three, and can be set to two or even four or more in accordance with the temperature range in which the liquid crystal display device 400 is used.

In FIG. 21, the temperature sensor 35 is provided in the timing control circuit 30, but it may be provided on the liquid crystal panel 10, rather than in the timing control circuit 30. In such a case, the timing control circuit 30 acquires temperature information from the temperature sensor 35 via serial communication, and selects one of the LUTs 470*a* to 470*c* in accordance with the temperature information. Note that in the case where the temperature sensor 35 is provided on an insulating substrate and provides temperature information to the timing control circuit 30 via serial communication, the temperature sensor can be disposed in any position on the insulating substrate. Moreover, in the case where the temperature sensor 35 is provided in the timing control circuit 30, the configuration of the timing control circuit 30 does not become complex. Accordingly, the production cost for the liquid crystal display device 400 can be reduced.

<3.2 Effects>

In the present embodiment, one of the LUTs 470*a* to 470*c* is selected in accordance with the ambient temperature around the liquid crystal display device 400 to perform overshoot drive, and therefore, the overshoot drive can be optimized regardless of the temperature. As a result, also in the liquid crystal display device 400 to be used in a wide range of temperatures, the decrease in luminance at the time of writing signal voltages can be suppressed so that the viewer barely recognizes flicker.

<3.3 First Variant>

Figure 25:
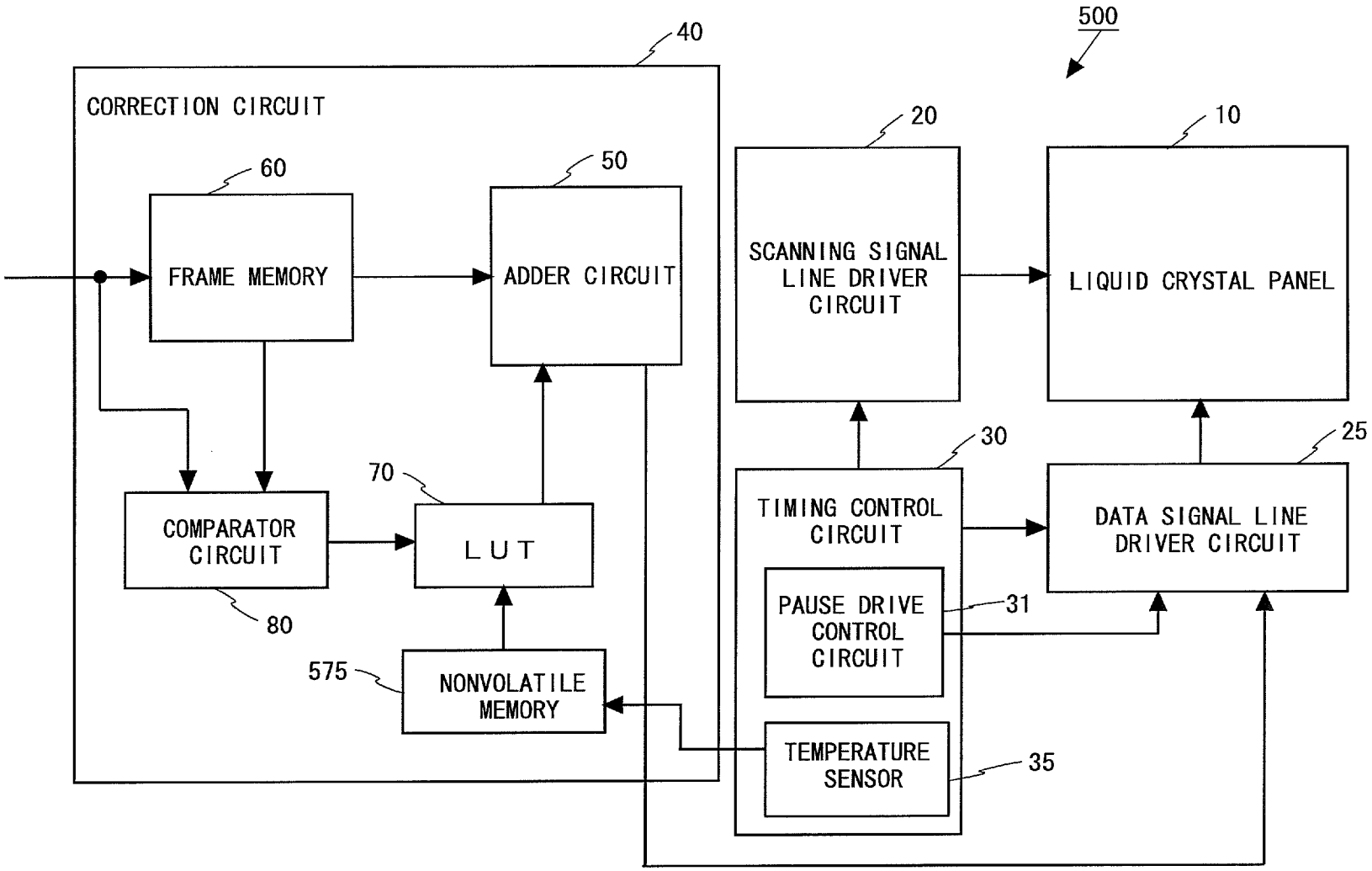
FIG. 25 is a block diagram illustrating the configuration of a liquid crystal display device according to a first variant of the third embodiment of the present invention.

FIG. 25 is a block diagram illustrating the configuration of a liquid crystal display device 500 according to a first variant of the present embodiment. As shown in FIG. 25, the liquid crystal display device 500 has the same configuration as that of the liquid crystal display device 400 shown in FIG. 21, except that nonvolatile memory 575 is provided in the correction circuit 40, temperature information from the temperature sensor 35 is provided to the nonvolatile memory 575, and the number of LUTs 70 is decreased from three to one. Note that in FIG. 25, the same components as those shown in FIGS. 1 and 21 are denoted by the same reference characters as those assigned to the components shown in FIGS. 1 and 21, any descriptions thereof will be omitted, and different components will be described mainly.

The nonvolatile memory 575 has prestored data for correction values for room temperature, high temperature, and low temperature. On the basis of temperature information from the temperature sensor 35, data for correction values corresponding to the temperature information is transferred from the nonvolatile memory 575 to the LUT 70. As a result, correction values correlated with the grayscale values for the previous and current frames can be read, as in the case shown in FIG. 21. The subsequent operations are the same as in the third embodiment, and therefore, any descriptions thereof will be omitted.

In this case, even when there is a need to prepare a plurality of LUTs because the liquid crystal display device 400 is used in a wide range of temperatures, only one LUT 70 is provided, and the correction values that should be stored in a plurality of LUTs are stored in the nonvolatile memory 575. In addition, data for correction values for a temperature range corresponding to temperature information provided by the temperature sensor 35 is transferred to the LUT 70. As a result, the number of LUTs can be reduced, resulting in reduced production cost for the liquid crystal display device 500.

<3.4 Second Variant>

Figure 26:
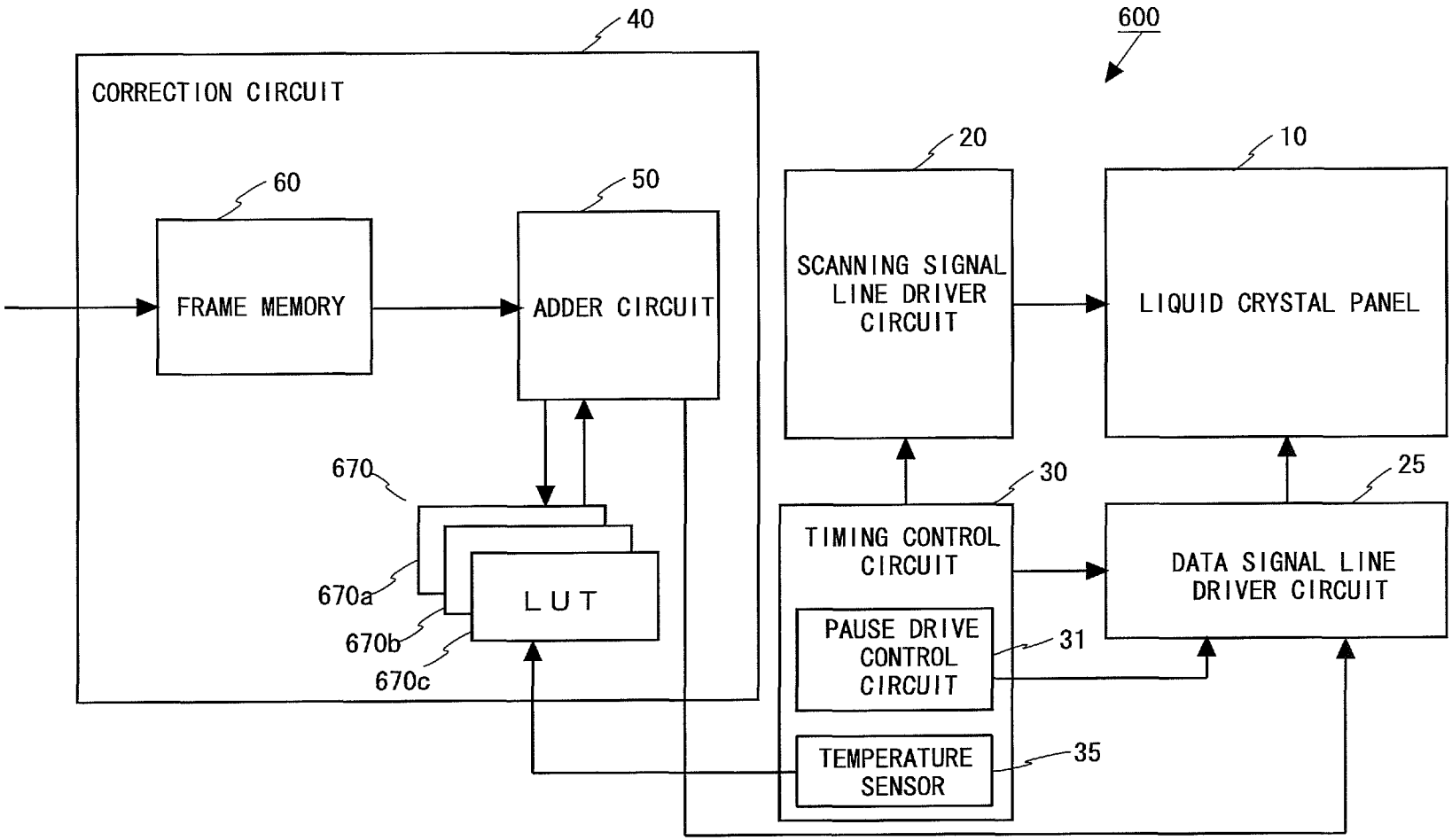
FIG. 26 is a block diagram illustrating the configuration of a liquid crystal display device according to a second variant of the third embodiment of the present invention.
Figure 27:
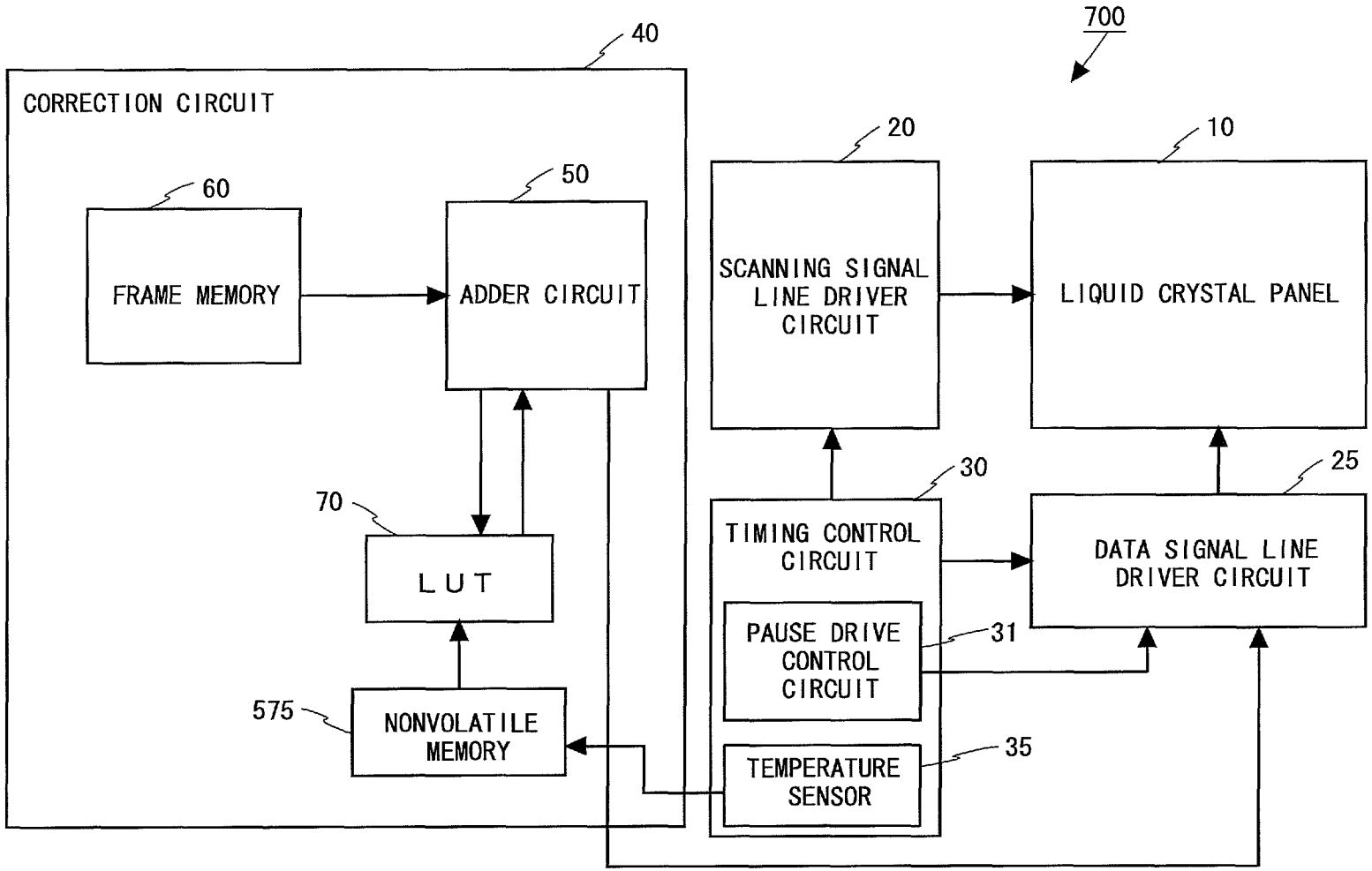
FIG. 27 is a block diagram illustrating the configuration of another liquid crystal display device according to the third variant of the third embodiment of the present invention.

FIG. 26 is a diagram illustrating a liquid crystal display device 600, which is equivalent to the liquid crystal display device 400 shown in FIG. 21 without the comparator circuit, and FIG. 27 is a diagram illustrating a liquid crystal display device 700, which is equivalent to the liquid crystal display device 500 shown FIG. 25 without the comparator circuit. The liquid crystal display device 600 shown in FIG. 26 has three LUTs 670*a* to 670*c* for different temperature ranges, which have stored therein correction values only corresponding to grayscale values for the current frame, and the liquid crystal display device 600 selects one of the three LUTs 670*a* to 670*c* in accordance with temperature information provided by the temperature sensor 35. Moreover, in the liquid crystal display device 700 shown in FIG. 27, data for three types of correction values only corresponding to grayscale values for the current frame is stored in nonvolatile memory 575 for different temperature ranges, and in accordance with temperature information provided by the temperature sensor 35, data for corresponding correction values is transferred to the LUT 70.

The liquid crystal display device 600 does not have any comparator circuit, and therefore, as with the LUT 370 shown in FIG. 17, the LUTs 670*a* to 670*c* have only stored therein correction values corresponding to the grayscale values for the current frame. In this manner, the correction values are determined solely by the grayscale values for the current frame, regardless of grayscale values for the previous frame. Accordingly, the adder circuit 50 generates a corrected image signal by adding correction values stored in one of the LUTs 670*a* to 670*c* selected in accordance with the temperature to all grayscale values for the current frame, regardless of grayscale values for the previous frame, and outputs the generated signal to the data signal line driver circuit 25.

Likewise, the liquid crystal display device 700 does not have any comparator circuit, and therefore, as with the LUT 370 shown in FIG. 17, the nonvolatile memory 575 has only stored therein correction values corresponding to grayscale values for the current frame. In this manner, the correction values are determined by the grayscale values for the current frame, regardless of grayscale values for the previous frame. Accordingly, the adder circuit 50 of the liquid crystal display device 700 also generates a corrected image signal by adding correction values, which are selected in accordance with the temperature from among the data stored in the nonvolatile memory 575 for different temperature ranges, to all grayscale values for the current frame, regardless of grayscale values for the previous frame, and outputs the generated signal to the data signal line driver circuit 25. Note that in any of the cases, normal drive is performed in the same manner as in the liquid crystal display device 400 shown in FIG. 21 or the liquid crystal display device 500 shown in FIG. 25, and therefore, any description thereof will be omitted.

The present variant further eliminates the need for the comparator circuit, resulting in further reduced production cost for the liquid crystal display devices 600 and 700.

4. Fourth Embodiment

In the above embodiments, the LUTs have prestored correction values correlated with grayscale values for both the previous and current frames or only for the current frame. The adder circuit 50 generates a corrected image signal by adding correction values provided by the LUTs to the grayscale values for the current frame, and outputs the generated signal to the data signal line driver circuit 25. However, the adder circuit 50 may have only one correction value stored therein, and use the correction value to correct the grayscale values for the current frame, regardless of the grayscale values for the current frame.

<4.1 Configuration of the Liquid Crystal Display Device>

Figure 28:
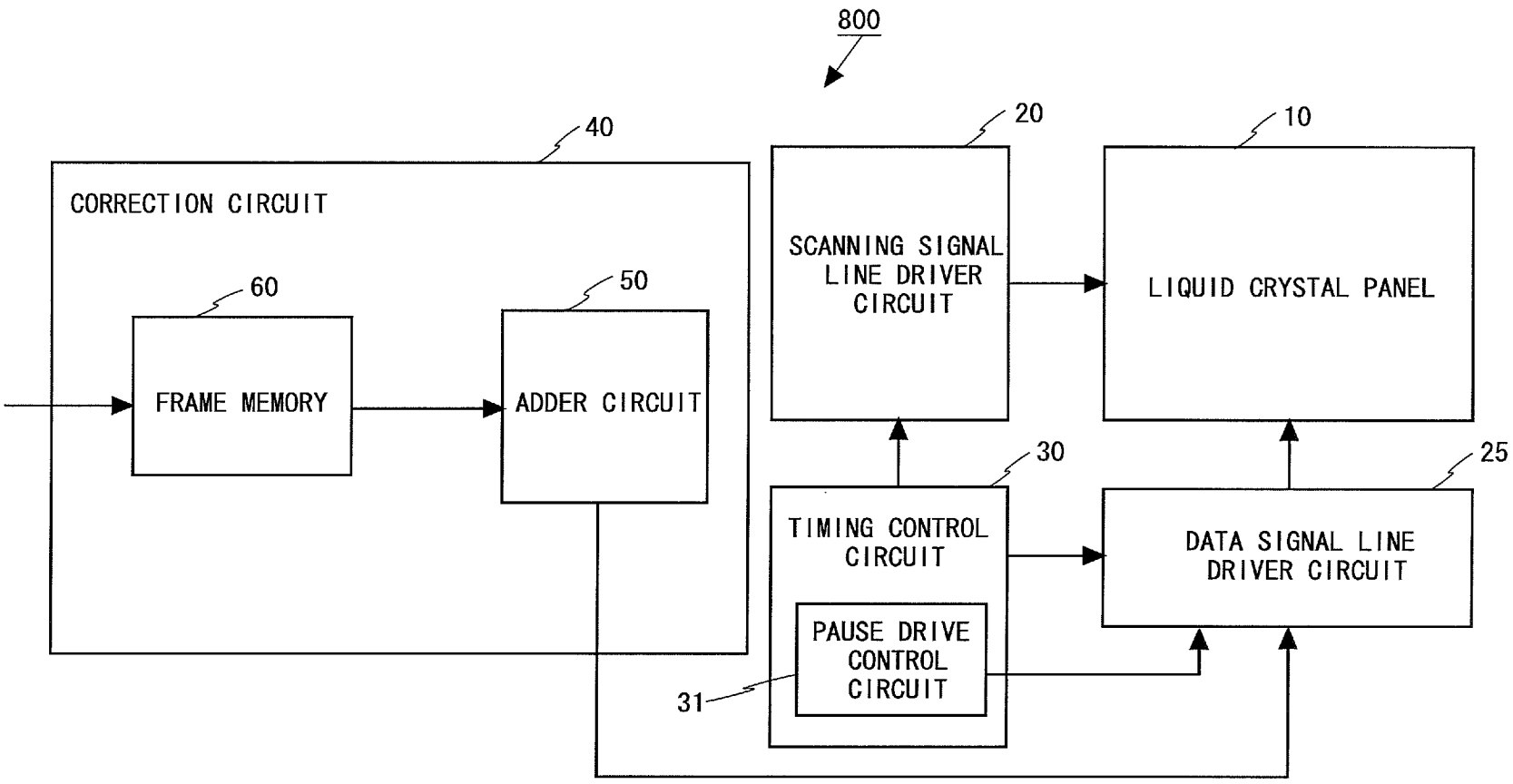
FIG. 28 is a block diagram illustrating the configuration of a liquid crystal display device according to a fourth embodiment of the present invention.

FIG. 28 is a block diagram illustrating the configuration of a liquid crystal display device 800 according to a fourth embodiment of the present invention. The liquid crystal display device 800 shown in FIG. 28 differs from the liquid crystal display device 100 shown in FIG. 1 in that the correction circuit 40 includes neither the comparator circuit nor the LUT. Accordingly, a correction value required for generating overshoot voltages is always set constant regardless of the grayscale value for the current frame, and is stored in the adder circuit 50. Note that in FIG. 28, the same components as those shown in FIG. 1 are denoted by the same reference characters as those assigned to the components shown in FIG. 1, any descriptions thereof will be omitted, and different components will be described mainly.

Figure 29:
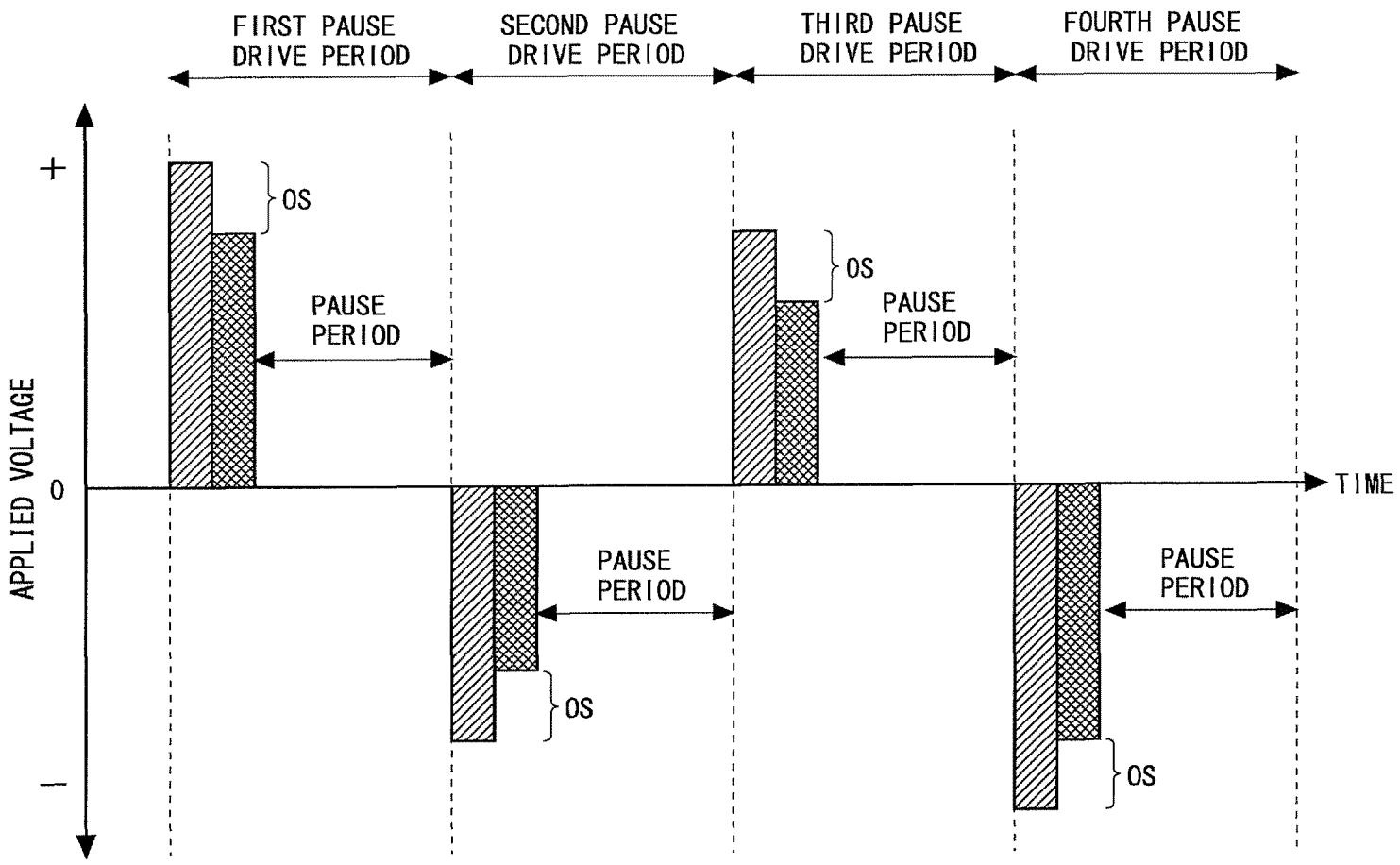
FIG. 29 is a diagram describing pause drive by the liquid crystal display device shown in FIG. 28.
Figure 30:
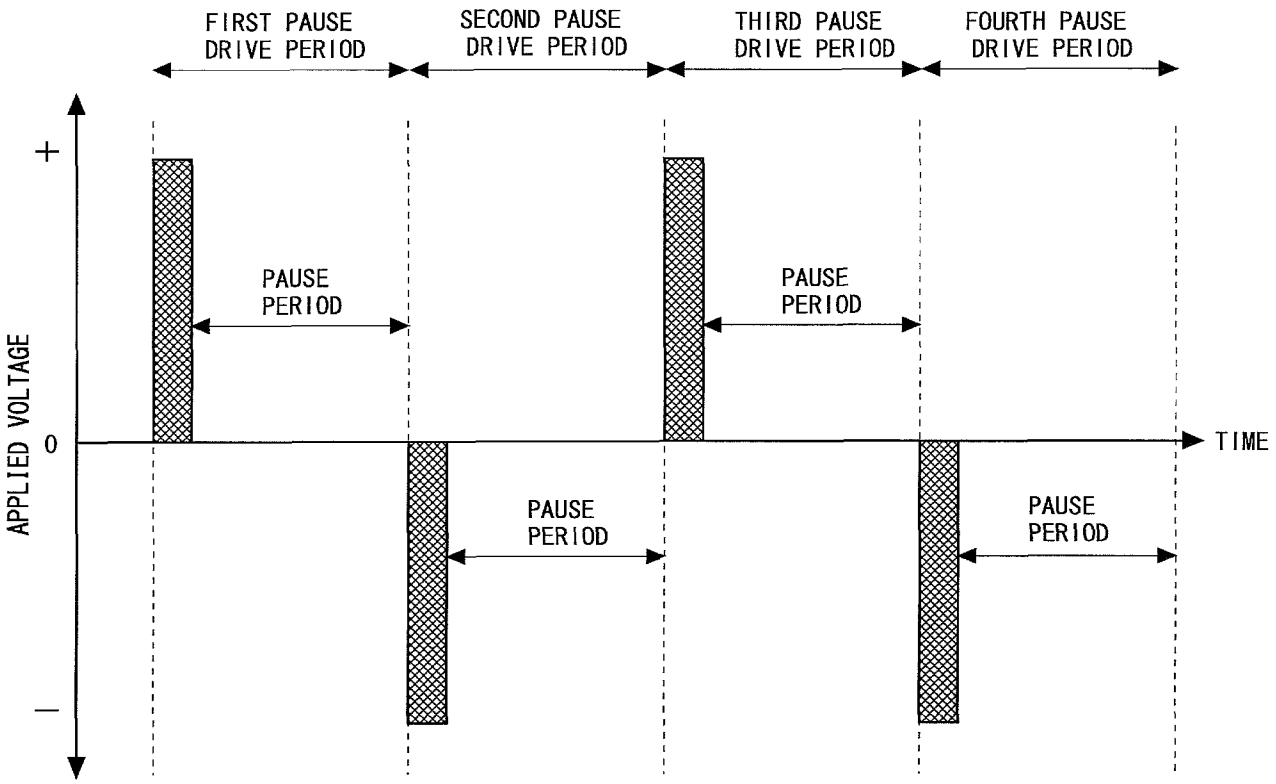
FIG. 30 PRIOR ART
FIG. 30 is a diagram describing a conventional method for performing pause drive in an alternating-voltage drive mode.

FIG. 29 is a diagram describing pause drive in the present embodiment. As shown in FIG. 29, first and second drive frames are set consecutively within each pause drive period. In the first drive frame, an input image signal is provided to the adder circuit 50 immediately after the signal is stored in the frame memory 60. The adder circuit 50 generates a corrected image signal by adding the prestored correction value to grayscale values for the current frame for the input image signal, and outputs the generated signal to the data signal line driver circuit 25. As a result, overshoot drive can be performed.

Next, in the second drive frame, the input image signal stored in the frame memory 60 during the first drive frame is provided to the adder circuit 50. The adder circuit 50 outputs the input image signal to the data signal line driver circuit 25 as an image signal without addition of the correction value. As a result, overshoot drive is performed in the first drive frame, and normal drive is performed in the second drive frame. Thereafter, an image written by normal drive continues to be displayed in the following pause period.

<4.2 Effects>

The present embodiment achieves similar effects to those achieved by the first embodiment, and eliminates the need for the LUT and the adder circuit, resulting in further reduced production cost for the liquid crystal display device 800.

<5. Others>

The liquid crystal display devices according to the above embodiments and their variants are driven by dot-by-dot inversion drive. However, in addition to dot-by-dot inversion drive, other alternating-voltage drive modes, such as line-by-line inversion drive, column-by-column inversion drive, or frame-by-frame inversion drive, can also be applied to achieve the same effects as those achieved by dot-by-dot inversion drive.

INDUSTRIAL APPLICABILITY

The present invention is applied to liquid crystal display devices capable of suppressing reduction of display quality by performing overshoot drive using correction values provided by an LUT during pause drive immediately before normal drive is performed to write signal voltages.

DESCRIPTION OF THE REFERENCE CHARACTERS

10 liquid crystal panel
15 pixel forming portion
16 thin-film transistor (TFT)
17 pixel electrode
18 common electrode
20 scanning signal line driver circuit
25 data signal line driver circuit
30 timing control circuit
35 temperature sensor
40 correction circuit
50 adder circuit
60 frame memory
70, 270, 370, 470, 670 look-up table (LUT)
80 comparator circuit
100, 200, 300, 400, 500, 600, 700, 800 liquid crystal display device
575 nonvolatile memory
Ccl liquid crystal capacitance
GL scanning signal line
SL data signal line

The invention claimed is:

1. A liquid crystal display device formed on an insulating substrate and performing pause drive in an alternating-voltage drive mode, the device comprising:

a plurality of scanning signal lines;

a plurality of data signal lines crossing each of the scanning signal lines;

pixel forming portions provided at intersections of the scanning signal lines and the data signal lines;

a correction circuit that outputs either a corrected image signal generated by adding a correction value to an input image signal or an uncorrected image signal generated by not adding anything to the input image signal;

a scanning signal line driver circuit that sequentially selects and scans the scanning signal lines;

a data signal line driver circuit that writes to the data signal lines correction voltages in accordance with the corrected image signal outputted by the correction circuit or uncorrected signal voltages in accordance with the uncorrected image signal; and a timing control circuit that controls the scanning signal line driver circuit and the data signal line driver circuit, wherein, the pause drive alternatingly repeats a drive period consisting of a plurality of drive frames and a pause period following the drive period and lasting until the start of the next drive period, the correction circuit outputs one of the corrected image signal and the uncorrected image signal to the data signal line driver circuit at least during the first drive frame of the drive period and also outputs the uncorrected image signal to the data signal line driver circuit during the last drive frame, and the correction voltages in accordance with the corrected image signal has the same polarity as the uncorrected signal voltages and an absolute value greater than or equal to an absolute value of the uncorrected signal voltages.

2. The liquid crystal display device according to claim 1, wherein, the correction circuit includes:

frame memory that stores the input image signal every frame;

a comparator circuit that obtains grayscale values for a current frame for the input image signal and grayscale values for a previous frame stored in the frame memory;

a table having stored correction values correlated with combinations of grayscale values for the current and previous frames for the input image signals; and an adder circuit that outputs either the corrected image signal or the uncorrected image signal to the data signal line driver circuit in accordance with the input image signal, the table provides the adder circuit with the correction values correlated with the grayscale values for the current and previous frames every time the comparator circuit provides the grayscale values for the current and previous frames for the input image signal, and the adder circuit outputs the corrected image signal by correcting the grayscale values for the input image signal with the correction values provided by the table and also outputs the uncorrected image signal without correcting the grayscale values for the input image signal.

3. The liquid crystal display device according to claim 2, wherein the adder circuit outputs the corrected image signal in each of two or more consecutive drive frames including the first drive frame, and outputs the uncorrected image signal during the last drive frame.

4. The liquid crystal display device according to claim 1, wherein, the correction circuit includes:

frame memory that stores the input image signal every frame;

a comparator circuit that obtains grayscale values for a current frame for the input image signal and grayscale values for a previous frame stored in the frame memory;

a table having stored correction values correlated with combinations of grayscale values for the current and previous frames for the input image signals when the grayscale values for the current and previous frames are equal; and an adder circuit that outputs either the corrected image signal or the uncorrected image signal in accordance with the input image signal, the comparator circuit provides the table with grayscale values for the current and previous frames for the input image signal only when the grayscale values for the current and previous frames for the input image signal are equal or substantially equal, the table provides the adder circuit with the correction values correlated with the grayscale values for the current and previous frames provided by the comparator circuit, when the grayscale values for the current and previous frames for the input image signal are essentially equal, the adder circuit outputs the corrected image signal by correcting the grayscale values for the input image signal with the correction values provided by the table and also outputs the uncorrected image signal without correcting the grayscale values for the input image signal, and when the grayscale values for the current and previous frames for the input image signal are essentially not equal, the adder circuit outputs the corrected image signal at least once without correcting the grayscale values for the input image signal.

5. The liquid crystal display device according to claim 4, wherein, when the grayscale values for the current and previous frames for the input image signal are not equal, the adder circuit outputs the corrected image signals successively without correcting the grayscale values for the input image signal.

6. The liquid crystal display device according to claim 4, wherein, the comparator circuit further obtains an inverting direction in which the input image signal is inverted in polarity for each of the drive periods, and the table includes first and second tables having stored different correction values in accordance with directions of the polarity, such that every time grayscale values for the current and previous frames for the input image signal and a direction of the polarity are provided by the comparator circuit, the adder circuit is provided with the correction values correlated with the grayscale values for the current and previous frames from one of the first and second tables corresponding to the direction of the polarity.

7. The liquid crystal display device according to claim 1, wherein, the correction circuit includes:

frame memory that stores the input image signal every frame;

a table having stored correction values correlated with grayscale values for a current frame for the input image signal; and an adder circuit that outputs either the corrected image signal or the uncorrected image signal in accordance with the input image signal, the table provides the adder circuit with correction values corresponding to the grayscale values for the current frame every time the input image signal is provided, and the adder circuit outputs the corrected image signal by correcting the grayscale values for the input image signal with the correction values provided by the table and also outputs the uncorrected image signal without correcting the grayscale values for the input image signal.

8. The liquid crystal display device according to claim 1, wherein, the correction circuit includes:

frame memory that stores the input image signal every frame; and an adder circuit that outputs either the corrected image signal or the uncorrected image signal in accordance with the input image signal, and the adder circuit stores one correction value and outputs the corrected image signal by correcting the grayscale values for the input image signal with the correction value, while outputting the uncorrected image signal without correcting the grayscale values for the input image signal.

9. The liquid crystal display device according to claim 2, further comprising a temperature sensor that measures an ambient temperature around the liquid crystal display device, wherein, the table includes a plurality of sub-tables having stored different correction values for predetermined temperature ranges, and one of the sub-tables is selected in accordance with temperature information provided by the temperature sensor.

10. The liquid crystal display device according to claim 2, further comprising a temperature sensor that measures an ambient temperature around the liquid crystal display device, wherein, the correction circuit further includes nonvolatile memory that stores a plurality of data items for different correction values for predetermined temperature ranges, and one of the data items is selected and provided to the table in accordance with temperature information provided by the temperature sensor.

11. The liquid crystal display device according to claim 9, wherein, the temperature sensor is provided on the insulating substrate, and the temperature sensor provides the temperature information to the timing control circuit via serial communication.

12. The liquid crystal display device according to claim 9, wherein the temperature sensor is provided in the timing control circuit.

13. The liquid crystal display device according to claim 1, wherein the pixel forming portion includes a thin-film transistor including a control terminal connected to the scanning signal line, a first conductive terminal connected to the data signal line, a second conductive terminal connected to a pixel electrode to which the correction voltages or the uncorrected signal voltages is to be applied, and a channel layer formed of an oxide semiconductor.

14. The liquid crystal display device according to claim 1, wherein the pixel forming portion includes a thin-film transistor including a control terminal connected to the scanning signal line, a first conductive terminal connected to the data signal line, a second conductive terminal connected to a pixel electrode to which the correction voltages or the uncorrected signal voltages is to be applied, and a channel layer formed of either an amorphous semiconductor or a polycrystalline semiconductor.

15. The liquid crystal display device according to claim 1, wherein the liquid crystal display device is driven by dot-by-dot inversion drive, line-by-line inversion drive, column-by-column inversion drive, or frame-by-frame inversion drive in the alternating-voltage drive mode.

16. A method for driving a liquid crystal display device performing pause drive in an alternating-voltage drive mode and including a plurality of scanning signal lines, a plurality of data signal lines crossing each of the scanning signal lines, pixel forming portions formed at intersections of the scanning signal lines and the data signal lines, a correction circuit that outputs either a corrected image signal generated by adding a correction value to an input image signal or an uncorrected image signal generated by not adding anything to the input image signal, a scanning signal line driver circuit that sequentially selects and scans the scanning signal lines, and a data signal line driver circuit that writes to the data signal lines correction voltages in accordance with the corrected image signal or uncorrected signal voltages in accordance with the uncorrected image signal, the method comprising the steps of:

outputting one of the corrected image signal and the uncorrected image signal at least during the first of a plurality of drive frames provided in a drive period;

outputting the uncorrected image signal during the last drive frame, wherein the uncorrected signal voltages have the same polarity as the correction voltages and an absolute value less than or equal to an absolute value of the correction voltages; and setting a pause period following the drive period and lasting until the start of the next drive period.

* * * * *